US009894994B2

(12) United States Patent
Raid et al.

(10) Patent No.: US 9,894,994 B2
(45) Date of Patent: Feb. 20, 2018

(54) PULL-OUT GUIDE

(71) Applicant: FULTERER Gesellschaft mbH, Lustenau (AT)

(72) Inventors: Karl Raid, Hohenweiler (AT); Wolfgang Muller, Lustenau (AT)

(73) Assignee: FULTERER GESELLSCHAFT MBH, Lustenau (AT)

( * ) Notice: Subject to any disclaimer, the term of this patent is extended or adjusted under 35 U.S.C. 154(b) by 0 days.

(21) Appl. No.: 14/747,160

(22) Filed: Jun. 23, 2015

(65) Prior Publication Data

US 2015/0366346 A1 Dec. 24, 2015

(30) Foreign Application Priority Data

Jun. 23, 2014 (AT) ..... A 489/2014

(51) Int. Cl.
*A47B 88/10* (2006.01)
*A47B 88/427* (2017.01)
*A47B 88/493* (2017.01)

(52) U.S. Cl.
CPC ..... *A47B 88/427* (2017.01); *A47B 88/493* (2017.01); *A47B 2210/0054* (2013.01); *A47B 2230/0014* (2013.01)

(58) Field of Classification Search
CPC ..... A47B 88/10; A47B 2230/0014; A47B 2210/0054; A47B 2210/0059; A47B 2210/0032; A47B 88/14; A47B 88/0466; A47B 2210/0081; A47B 88/427
USPC ..... 312/333, 330.1, 334.1, 334.4, 334.5, 312/334.6, 334.12, 334.18, 334.7; 384/18–22, 49, 26, 40
See application file for complete search history.

(56) References Cited

U.S. PATENT DOCUMENTS 4,436,357 A * 3/1984 Rock ..... A47B 88/10 312/334.12
5,344,227 A 9/1994 Rock et al.
(Continued)

FOREIGN PATENT DOCUMENTS

DE 7535313 3/1976
DE 2549444 5/1977
(Continued)

*Primary Examiner* — Daniel J Troy
*Assistant Examiner* — Hiwot Tefera
(74) *Attorney, Agent, or Firm* — Volpe and Koenig, P.C.

(57) ABSTRACT

A pull-out guide for pulling a pull-out furniture part out of a basic furniture structure, having at least a first and second guide rails, displaceable relative to one another in and counter to the pull-out direction. The first guide rail has a basic profile and at least one lateral-guidance unit retained on the basic profile and has a lateral-guidance part. The lateral-guidance part, which limits play of the second guide rail relative to the first guide rail in at least a transverse direction extending at right angles to the pull-out direction, interacts with a lateral-guidance surface of the second guide rail. The lateral-guidance unit has an openable and closeable locking device which, in an open state, allows adjustment of the lateral-guidance part in the transverse direction relative to the basic profile of the first guide rail by applying pressure on the lateral-guidance part parallel to the transverse direction, and in a closed state of the locking device, fixes the position of the lateral-guidance part.

13 Claims, 17 Drawing Sheets

(56) References Cited

U.S. PATENT DOCUMENTS 5,375,922 A * 12/1994 Brustle ..... A47B 88/0422 312/330.1
6,155,661 A * 12/2000 O'Neil ..... A47B 88/047 312/333
7,654,625 B2 2/2010 Amann et al.
7,695,080 B2 * 4/2010 Chen ..... A47B 88/0422 312/333
7,980,642 B2 * 7/2011 Lam ..... A47B 88/0422 312/333
8,172,345 B2 * 5/2012 Liang ..... A47B 88/0481 312/333
8,186,780 B2 * 5/2012 Liang ..... A47B 88/0422 312/334.5
8,777,340 B2 * 7/2014 Greussing ..... A47B 88/0422 312/334.4
8,783,799 B2 * 7/2014 Chen ..... A47B 88/0477 312/319.1
9,066,587 B1 * 6/2015 Liang ..... A47B 88/0422
9,380,872 B2 * 7/2016 Yoneda ..... A47B 88/04
9,427,084 B2 * 8/2016 Park ..... A47B 88/14
2003/0205955 A1 * 11/2003 Egger ..... A47B 88/044 312/334.5
2003/0234603 A1 * 12/2003 Salice ..... A47B 88/0407 312/334.5
2008/0157643 A1 * 7/2008 Chen ..... A47B 88/0481 312/334.6
2009/0039746 A1 * 2/2009 Lam ..... A47B 88/0422 312/334.1
2012/0080988 A1 * 4/2012 Greussing ..... A47B 88/0422 312/334.6

FOREIGN PATENT DOCUMENTS

| | | |
|---|---|---|
| DE | 7710556 | 8/1977 |
| DE | 2607435 | 9/1977 |
| DE | 202007014954 | 1/2009 |
| EP | 1483984 | 12/2004 |
| EP | 2327335 | 6/2011 |
| WO | 9213473 | 8/1992 |
| WO | 2009056326 | 5/2009 |

* cited by examiner

Fig.30
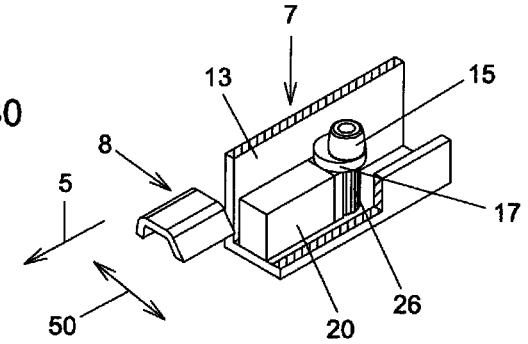
Fig. 31
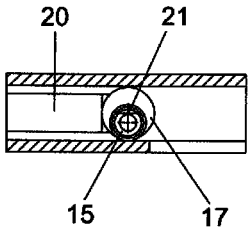
Fig. 32
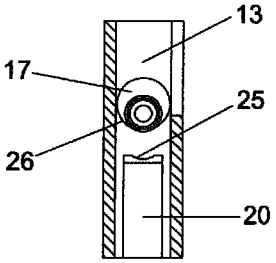
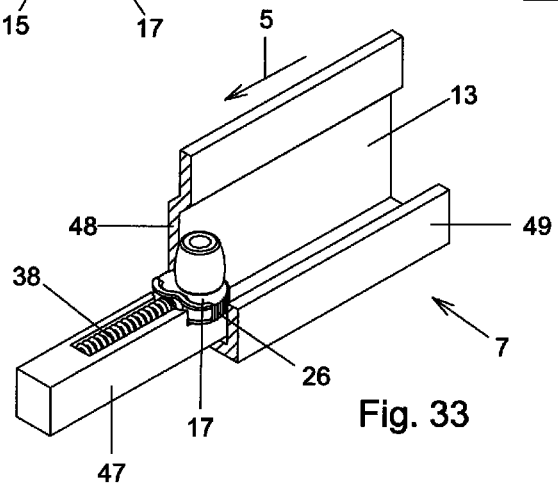
Fig. 33

Fig. 39
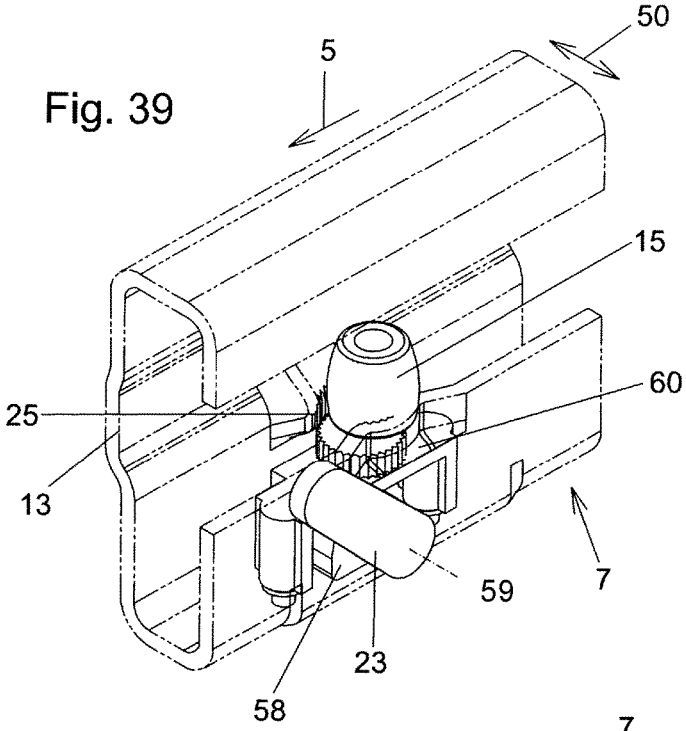
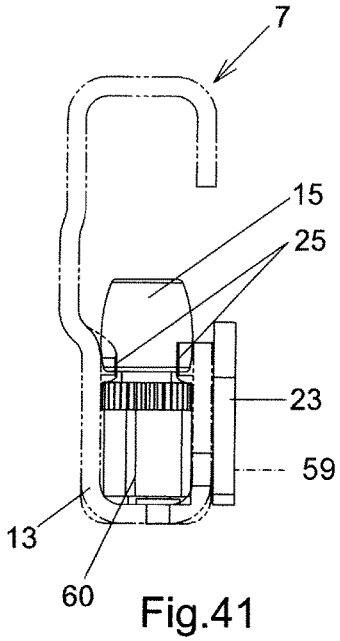
Fig.41
Fig. 40
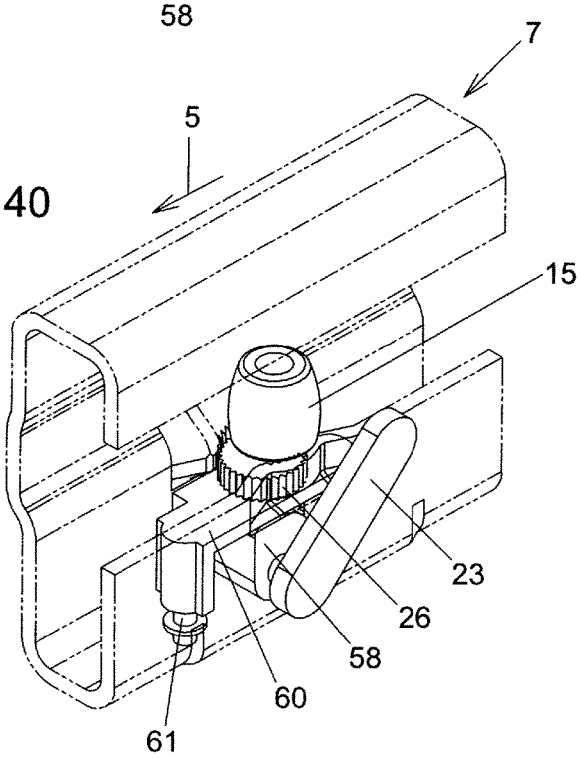
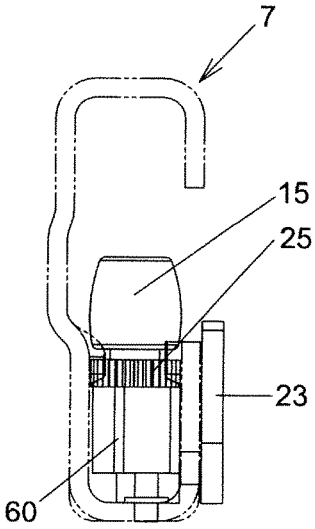
Fig. 42

PULL-OUT GUIDE

INCORPORATION BY REFERENCE

The following documents are incorporated herein by reference as if fully set forth: Austrian Patent Application No. A489/2014, Filed Jun. 23, 2014.

BACKGROUND

The invention relates to a pull-out guide for pulling a pull-out furniture part out of a basic furniture structure in a pull-out direction and for pushing the pull-out furniture part into the basic furniture structure counter to the pull-out direction, comprising at least a first and a second guide rail, which can be displaced relative to one another in and counter to the pull-out direction, wherein the first guide rail has a basic profile and at least one lateral-guidance unit, which is retained on the basic profile and has a lateral-guidance part, wherein the lateral-guidance part, in order to limit an amount of play of the second guide rail in relation to the first guide rail in at least one transverse direction running at right angles to the pull-out direction, interacts with at least one lateral-guidance surface of the second guide rail, and it is possible to adjust the position of the lateral-guidance part as seen in the transverse direction in relation to the basic profile of the first guide rail.

Pull-out guides serve for pulling a pull-out furniture part, such as a drawer, at least essentially rectilinearly out of a basic furniture structure. The pulling-out operation usually takes place in the horizontal direction, but other pull-out directions are also possible.

In general, a respective pull-out guide is provided on opposite sides of the pull-out furniture part, wherein the two pull-out guides are configured in a more or less mirror-inverted manner.

In particular running rollers which are arranged on at least one of the guide rails such that they can be rotated about axes or rolling-contact bodies, in particular in the form of balls, which are arranged in cages between running tracks of the guide rails are known for guiding the guide rails of pull-out guides in a displaceable manner in relation to one another. Sliding-guiding elements, if appropriate in conjunction with running rollers and/or rolling-contact bodies, are also known.

Such systems end up, both in respect of the dimensioning of the basic furniture structure, with deviations in the distance between the basic-structure-mounted guide rails, which are fastened on the basic furniture structure, on either side of the pull-out furniture part, and, in respect of the dimensioning of the pull-out furniture part, with deviations in the distance between the pull-out guide rails, which are fastened on either side of the pull-out furniture part. It is also the case that the pull-out guides themselves have certain deviations in their dimensions. These deviations are caused by tolerances during production of the various elements, by slight skewing of the furniture if the underlying surface on which the furniture is set out is not completely planar, by deviations in straightness of the structural elements used, and by flexing of the elements when subjected to loading during use. These deviations in the installation dimensions are compensated in different ways in the prior art.

In the case of known pull-out guides, in order to compensate for deviations in installation dimensions, the guide rails have a sufficiently large amount of play in relation to one another in the transverse direction, that is to say in the direction in which the pull-out guides fitted on either side of the pull-out furniture part are spaced apart. An amount of play of 1-3 mm is typically present on each side, and this means that, with conventional deviations in the installation dimensions, scraping noises or lateral friction do not occur. It is also the case that lateral-guidance elements in the form of sliding elements or rollers are known in order to reduce friction and noise even if there is contact in the transverse direction.

One disadvantage of such a design with relatively large amounts of lateral play is that, depending on the dimensions present in a specific installation, an amount of lateral play is noticeable to a more or less pronounced extent, in particular under a low load (=a low level of loading of the pull-out furniture part). In particular in the pull-out state, the lateral stability of such guide systems is deemed to be insufficient; the guidance system is "unstable". Even in the closed state, there is no defined lateral position of the guide within the amount of design-specific lateral play, and there is no alignment of the positions of front panels located one above the other.

In particular roller guides (with running rollers mounted in a rotatable manner about axes), but also guides with rolling carriages and sliding elements, are designed with such an amount of lateral play.

Also known are guide systems, in particular ball guides, which, for design reasons, do not have any lateral play. Deviations in the installation dimensions in the transverse direction are compensated for by profile structures being flexible in the transverse direction. The disadvantage of these solutions is a very restricted level of tolerance compatibility. Even a deviation in the installation dimensions in the transverse direction of one millimeter results in high lateral forces and, despite laterally acting rolling-contact bodies (balls), in noticeably increased frictional forces, and therefore, for example, it is also possible for the function of a spring-controlled self-retracting mechanism to be adversely affected. It is also the case that the lateral flexibility present gives rise, in particular in the pulled-out state, to an unstable impression if manual loading is applied laterally ("yielding" appearance).

In the case of a further conventional design, the pull-out guides on either side of the pull-out furniture part itself are designed without any play in the transverse direction, for example by lateral-guidance rollers (which absorb the weight of the pull-out furniture part) being present in addition to load-bearing rollers. In order to compensate for different installation dimensions in the transverse direction, the pull-out furniture part here has an amount of play in the transverse direction in relation to the respective pull-out guide. The advantage of this design is the relatively high level of tolerance compatibility in the transverse direction. The disadvantage, however, is that the amount of lateral play present between the pull-out furniture part and the pull-out guides fitted on either side of the latter is noticeable to the user, in particular in the pulled-out state.

It is also known that the pull-out furniture part can be connected to the pull-out guide in different positions as seen in the transverse direction. Such a design can be gathered from EP 1 483 984 A9. Here, there are elements present which allow side-wall parts of the drawer to latch with the pull-out guide rail of the pull-out guide at different positions as seen in the transverse direction. One disadvantage of this arrangement is the comparatively complicated design with a large number of parts. It is also the case that available stowage space is lost as a result of the large width of the structure, since a number of wall thicknesses have to be accommodated in the design.

DE 25 49 444 A1 discloses a pull-out guide of the type mentioned in the introduction. Adjustable lateral-guidance parts in the form of sliding elements or else rollers are present in order to adjust an amount of play between two guide rails of a pull-out guide in relation to the transverse direction. A lateral-guidance unit, which retains the lateral-guidance part or mounts the same in a rotatable manner, is fitted on one of the two guide rails, and the lateral-guidance part interacts on one side with a lateral-guidance surface of the other of the two guide rails. So that they cannot be adjusted automatically by the action of drawer forces, the adjusting means for adjusting the lateral-guidance parts are of self-locking design. The adjusting means provided for adjusting the lateral-guidance part is, for example, an eccentric which can be inserted in different rotary positions into a housing of the lateral-guidance unit, wherein the inserted eccentric is prevented from rotating in relation to the housing by interacting protrusions and depressions (in the manner of interacting toothing formations). The complicated adjustment of the lateral-guidance parts is disadvantageous. It is also the case that the adjusting means, at least if they are arranged in a central or rear region of the pull-out guide, are accessible only with difficulty, if at all, when a drawer has been inserted. It is then possible, with the drawer removed, to carry out adjustment on a trial-and-error basis, wherein it is only once the drawer has been inserted that it is established whether the adjustment is correct or whether readjustments have to be made. In addition to manually activated adjusting means, DE 25 49 444 A1 also mentions hydraulically or pneumatically actuated adjusting means. Such designs, however, are very costly.

DE 26 07 435 A1 likewise discloses a pull-out guide with adjustable lateral-guidance parts. In one of the embodiments disclosed, sliding pieces of different dimensions can be used in order to adjust the amount of play between the guide rails. Also disclosed is a sliding piece which is designed in the form of an eccentric and can be used in different rotary positions. Also illustrated is a rotary piece, on which the lateral-guidance rollers are mounted in a rotatable manner. The rotary piece can be fastened in different rotary positions on a bearing part, for example by the axis of rotation being provided in the form of a screw which is tightened once the position of the rotary piece has been adjusted. The lateral-guidance parts which can be gathered from this document likewise interact on one side with a lateral-guidance surface of the other guide rail. It is also the case for the pull-out guides known from DE 26 07 435 A1 that relatively complicated manual adjustment is necessary.

Similar designs can be gathered from DE 77 10 556 U. Lateral-guidance parts which are designed in the form of sliding elements and interact on one side with a lateral-guidance surface on the other guide rail are adjusted in position in relation to the transverse direction by means of manually activated adjusting elements. The adjusting elements disclosed are an adjusting screw and an eccentric disk, which can be arrested in a stepwise manner by means of toothing formations.

SUMMARY

It is an object of the invention to provide an advantageous pull-out guide of the type mentioned in the introduction which allows straightforward adjustment of the position of the lateral-guidance part as seen in the transverse direction. This is achieved with a pull-out guide including one or more features according to the invention.

In the case of a pull-out guide according to the invention, the lateral-guidance unit has an openable and closeable locking device. In an open state of the locking device, the position of the lateral-guidance part as seen in the transverse direction can be adjusted in relation to the basic profile of the first guide rail by a pressure acting on the lateral-guidance part parallel to the transverse direction. In a closed state of the locking device, the position of the lateral-guidance part as seen in the transverse direction is fixed.

A straightforward installation operation can be achieved by the design according to the invention. In particular one of the two guide rails is connected to the basic furniture structure (directly or via a further guide rail) and the other of the two guide rails is connected to the pull-out furniture part (directly or via a further guide rail), and then, in the open state of the locking device of the at least one lateral-guidance unit, the initially separated guide rails are inserted one inside the other. Since, in the open state of the locking device, the position of the lateral-guidance part of the at least one lateral-guidance unit as seen in the transverse direction can be adjusted in relation to the basic profile of the first guide rail by a pressure acting on the lateral-guidance part parallel to the transverse direction, the lateral-guidance part can assume a position (as seen in the transverse direction) which is adapted to the specific installation situation in each case.

In an advantageous design, it is possible here to provide at least one spring, which retains the lateral-guidance part in a starting position, preferably in the center position, without any external force acting on the lateral-guidance part. When the first and second guide rails are put together in the open state of the locking device, it is possible for the lateral-guidance part, depending on the dimensions which are specifically present in the transverse direction, to be adjusted more or less out of its starting position (in its position as seen in the transverse direction), wherein the at least one spring pushes the lateral-guidance part onto the lateral-guidance surface of the second guide rail.

Once the first and second guide rails have been put together, the locking device is closed, and therefore the position of the at least one lateral-guidance part as seen in the transverse direction is secured and, as a result, the lateral-guidance part, interacting with the at least one lateral-guidance surface assigned to it, performs the desired guidance function in relation to the transverse direction.

The locking device can be closed by manual actuation of an actuating element, for example by a lever being turned, or automatically, when the pull-out guide is being pushed together, by a stop surface of the second guide rail running onto an actuating element of the first guide rail, said actuating element being designed, for example, in the form of a lever.

In order to fix the lateral-guidance part in the closed state of the locking device, a carrying part, which carries the lateral-guidance part, is advantageously braced with a clamping part of the lateral-guidance unit or a clamping portion of the basic profile of the first guide rail.

The lateral-guidance part is designed preferably in the form of a roller which is mounted by the carrying part such that it can be rotated about an axis, which is located in particular vertically (as seen in the operating position).

In one possible embodiment, the carrying part is designed in the form of an eccentric. For this purpose, in the open state of the locking device, the carrying part can be rotated about an axis of rotation, in particular a vertical axis of rotation. In the closed state of the locking device, the eccentric is arrested by the locking device against rotation about the axis of rotation.

Instead of such a positioning of the lateral-guidance part by means of an eccentric, it would also be possible for the lateral-guidance part to be positioned as seen in the transverse direction by a linear parallel displacement of the carrying part or by the carrying part being designed in the form of a pivoting arm which can be pivoted about an axis.

The at least one lateral-guidance surface with which the lateral-guidance part interacts in order to limit the amount of play of the first guide rail in relation to the second guide rail in the relevant direction parallel to the transverse direction extends in particular parallel to the pull-out direction, wherein the lateral-guidance surface is preferably of planar design and is located in a plane located parallel to the pull-out direction and at right angles to the transverse direction.

In preferred embodiments of the invention, the transverse direction is located horizontally.

A preferred design provides for the second guide rail to have lateral-guidance surfaces which are located on opposite sides of the at least one lateral-guidance part. The lateral-guidance part is thus located between the lateral-guidance surfaces, wherein the lateral-guidance part, between the lateral-guidance surfaces, has a merely small amount of play, of preferably smaller than 0.6 mm, particularly preferably smaller than 0.3 mm, in the transverse direction. It is possible, for example, for the amount of play to range from 0.03 mm to 0.6 mm, preferably to range from 0.05 mm to 0.3 mm. Such a small amount of play between the lateral-guidance part and the lateral-guidance surfaces is present preferably at least over more than 50% of the path over which the lateral-guidance part and the lateral-guidance surfaces are displaced in relation to one another between the fully pushed-together state of the pull-out guide and the fully pulled-out state of the pull-out guide (=the pull-out path). In particular if use is made of more than one lateral-guidance unit in a pull-out guide, it may be advantageous to increase the amount of play between the lateral-guidance surfaces and the lateral-guidance part, or to remove at least one of the lateral-guidance surfaces, over a region of the pull-out path, in particular following the fully-pushed together state of the pull-out guide. This makes it possible to reduce the friction in the vicinity of the fully pushed-together state of the pull-out guide (for example over 10 mm to 150 mm, preferably over 35 mm to 80 mm, of that portion of the pull-out path which follows the fully pushed-together state of the pull-out guide). This makes possible just a low level of necessary retracting forces in the case of a spring-controlled contracting mechanism and/or a low ramp angle in the case of a gravity-controlled retracting mechanism. Removal of at least one lateral-guidance surface also makes it possible to utilize installation space for some other function of the pull-out guide. A relatively large amount of lateral play for the pull-out guide is less important in the vicinity of the fully pushed-together state of the pull-out guide.

When the first and second guide rails are being put together the lateral-guidance part moves in between the two lateral-guidance surfaces, with appropriate positioning in relation to the transverse direction. In the closed state of the locking device, the lateral-guidance part, in the case of a force acting in one of the transverse directions, is in contact in each case with just one of the lateral-guidance surfaces. In the case of a change in loading direction, e.g. in the case of a slightly conical basic structure, the contact surface can be changed during the operation of pulling the pull-out guide out or of pushing it in. Irrespective of the tolerance situation and of the specifically fixed position of the lateral-guidance part as seen in the transverse direction in each case, it is always only the small amount of play between the lateral-guidance part and the lateral-guidance surfaces which is noticeable to the user.

The lateral-guidance part can move in between the lateral-guidance surfaces by way of a continuously increasing extent of the lateral-guidance part in the transverse direction over a region with which the lateral-guidance part moves in first of all between the lateral-guidance surfaces, as is the case anyway for a running roller. If use is made of a sliding part, the latter could be designed with a correspondingly tapering portion.

In addition, or instead, run-in slopes could be positioned in front of the lateral-guidance surfaces.

If the pull-out guide, in addition to the first and second guide rails, has at least one further guide rail, then there is advantageously an only small amount of play present in relation to said further guide rails, in particular of the aforementioned magnitude of the amount of play between the lateral-guidance part and the lateral-guidance surfaces.

One possible embodiment provides for the first guide rail to have at least two lateral-guidance units, which are spaced apart from one another as seen in the pull-out direction. The lateral-guidance units may be, in particular, of identical design. It is advantageous for the at least two lateral-guidance units of the first guide rail to interact with the same lateral-guidance surface or the same lateral-guidance surfaces, located on either side of the lateral-guidance parts). This can achieve effective stabilization against rotation of the pull-out furniture part. Such an arrangement is advantageous particularly for wide drawers.

An advantageous mechanism for pulling a pull-out furniture part out of a basic furniture structure provides for first and second pull-out guides designed in a manner according to the invention to be present. The two pull-out guides here, in the state in which they are installed on the pull-out furniture part, are spaced apart from one another in the transverse direction, in particular are arranged on either side of the pull-out furniture part, for example of a drawer. The first and second pull-out guides may be of mirror-inverted design, but this is not imperative.

Load-induced flexing of guide rails and/or the basic furniture structure may result in changes in dimensioning in relation to the transverse direction. It is then possible for the lateral-guidance parts of the lateral-guidance units to be subjected to pressure, and this reduces the flexing options of guide rails and/or basic structure. The lateral-guidance parts thus also provide a carrying function, but only for load-induced changes in installation width; not for tolerance-induced deviations in the installation widths.

BRIEF DESCRIPTION OF THE DRAWINGS

Further advantages and details of the invention will be explained hereinbelow with reference to the accompanying drawing, in which:

FIG. 30 shows a perspective view of a simplified illustration of a portion of the first guide rail with the lateral-guidance unit installed and of a portion of the second guide rail, according to a fourth exemplary embodiment of the invention;

FIG. 31 shows a plan view of the portion of the first guide rail with the lateral-guidance unit installed;

FIG. 32 shows a plan view analogous to FIG. 31, but in the open state of the locking device;

FIG. 33 shows a perspective view of a simplified illustration of a portion of the first guide rail and of the lateral-guidance unit;

FIG. 39 shows a perspective view of a portion of the first guide rail (illustrated by dashed lines) with the lateral-guidance unit installed, and in the open state of the locking device, according to a seventh exemplary embodiment of the invention;

FIG. 40 shows a perspective view analogous to FIG. 39 in the closed state of the locking device;

FIGS. 41 and 42 show end-side illustrations in the open and closed states of the locking device;

DETAILED DESCRIPTION OF THE PREFERRED EMBODIMENTS

The Figures are shown to different scales.

A first exemplary embodiment of the invention is illustrated in FIGS. 1 to 24. The pull-out guides are illustrated in a simplified manner. In particular stops for limiting the pulling-out and pushing-in operations have been omitted.

Figure 1:
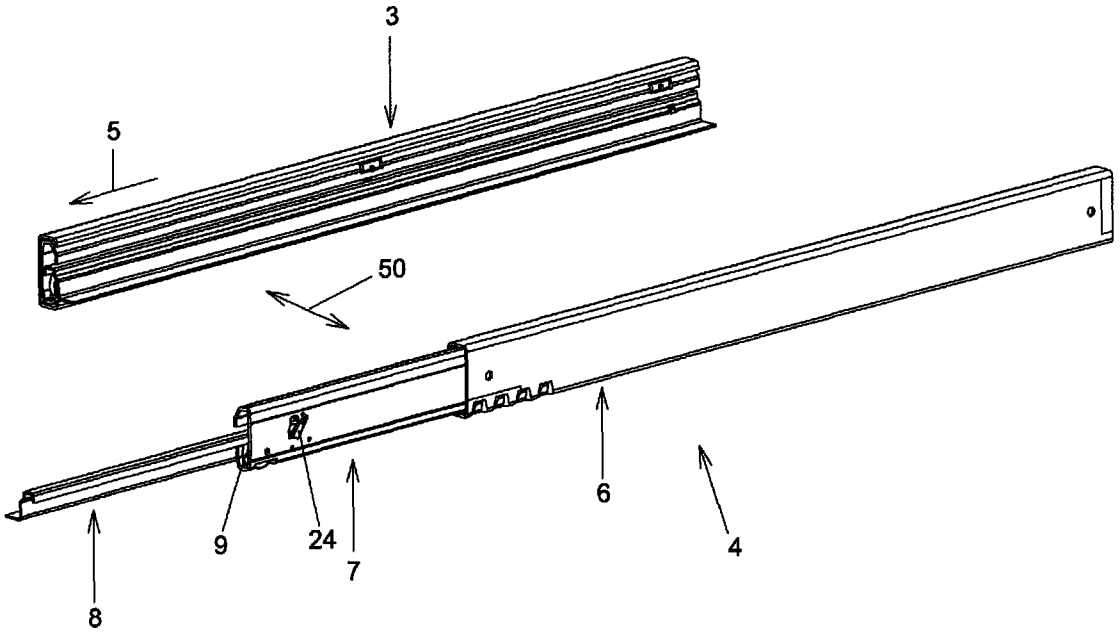
FIG. 1 shows a perspective view of first and second pull-out guides for arranging on either side of a pull-out furniture part, wherein one of the pull-out guides is illustrated in a fully retracted state and the other pull-out guide is illustrated in the partially pulled-out state.
Figure 2:
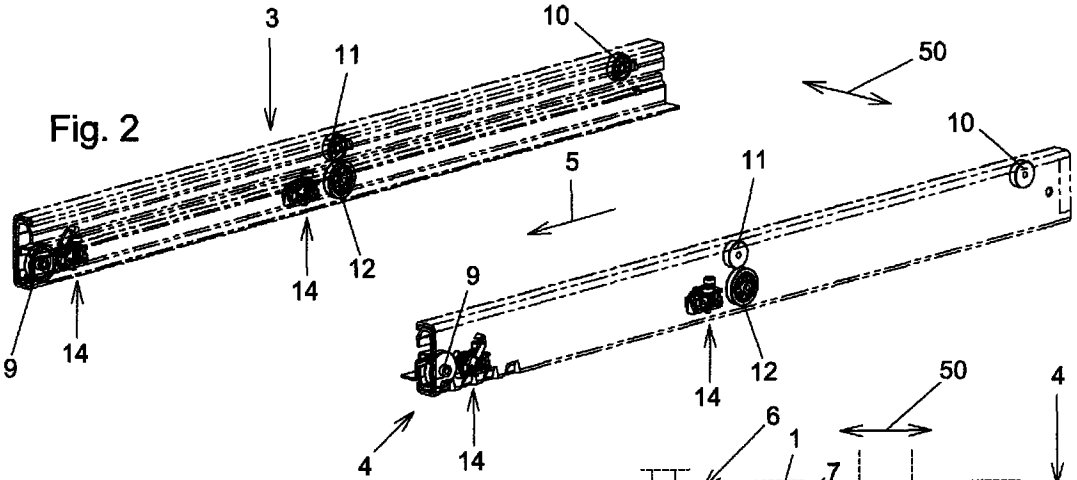
FIG. 2 shows the two pull-out guides from FIG. 1 in a fully retracted state, wherein the basic profiles of the guide rails are illustrated as being transparent and it is therefore possible to see the running rollers and lateral-guidance units.
Figure 3:
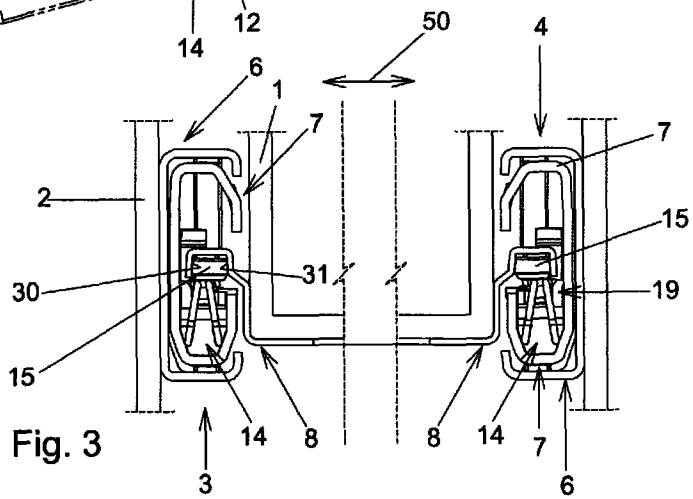
FIG. 3 shows an end-side view of the two guide rails with a schematically indicated basic furniture structure and pull-out furniture part.
Figure 4:
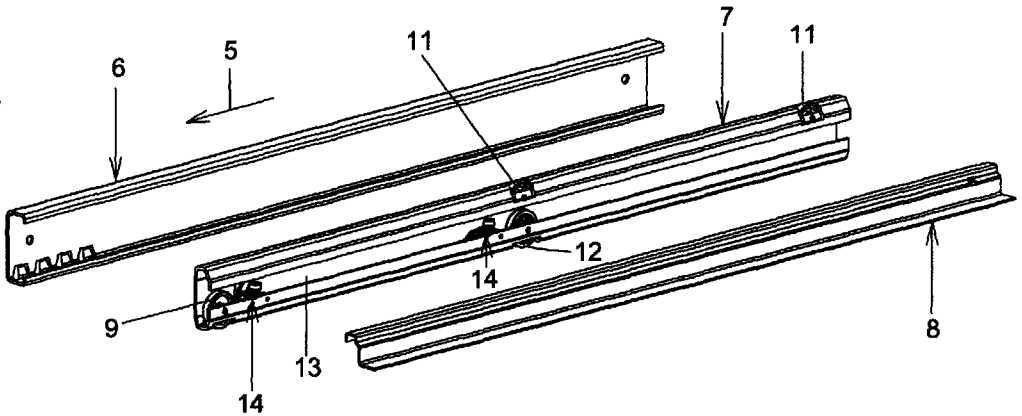
FIG. 4 shows one of the lateral-guidance units with the guide rails removed from one another.
Figure 5:
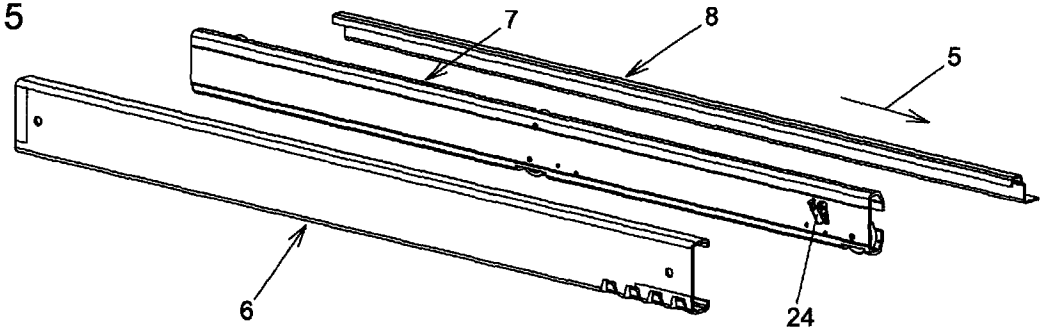
FIG. 5 shows a perspective view of the guide rails from FIG. 4 as seen from a different viewing direction.
Figure 6:
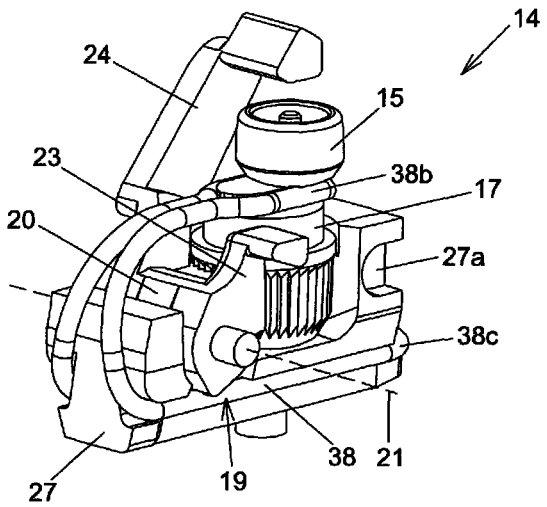
FIG. 6 shows a perspective view of a lateral-guidance unit.
Figure 7:
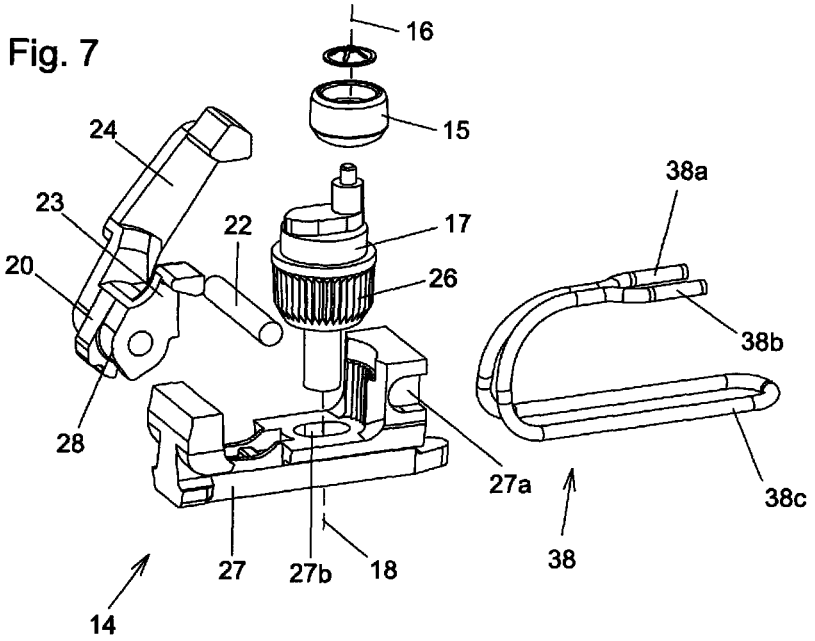
FIGS. 7 and 8 show exploded illustrations of the lateral-guidance unit as seen from different viewing directions.
Figure 8:
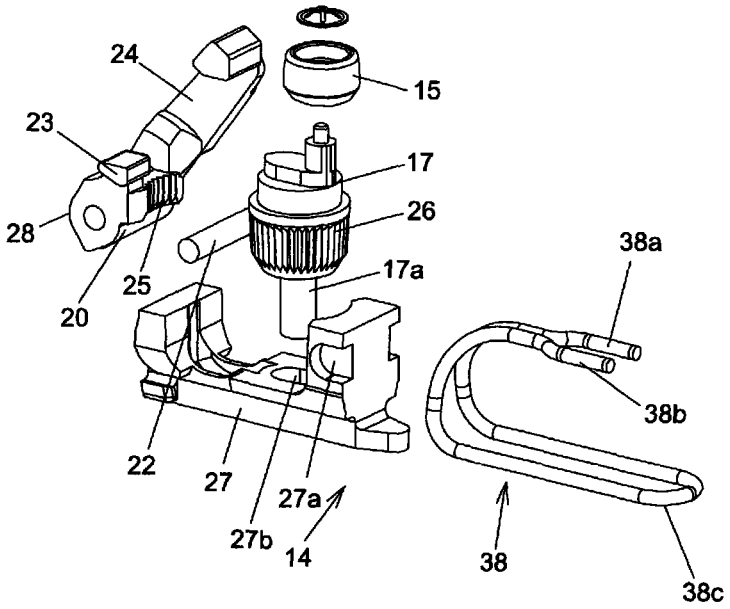

Pull-out guides 3, 4 are arranged on either side of a pull-out furniture part 1, of which a portion is indicated schematically only in FIG. 3, for the purpose of pulling the pull-out furniture part 1 out of a basic furniture structure 2, of which a portion 3 is illustrated schematically likewise only in FIG. 3. The pull-out furniture part 1 is pulled out in a pull-out direction 5 and is pushed into the basic furniture structure 2 counter to the pull-out direction 5. The pull-out furniture part 1 may be, for example, a drawer.

The pull-out guides 3, 4 which are arranged on either side of the pull-out furniture part 1, are spaced apart from one another in a transverse direction 50 running at right angles to the pull-out direction 5. In the exemplary embodiment, the transverse direction 50 is located horizontally, as seen in the operating position of the pull-out guide.

The transverse direction 50 is illustrated in the form of a double arrow in the Figures. Wherever this document refers to a transverse direction 50 or the transverse direction 50, this relates to one of the two directions of said double arrow.

In the exemplary embodiment, the pull-out guides 3, 4 which are arranged on either side of the pull-out furniture part 1, are of mirror-inverted design. It would also be possible, however, for the design not to be mirror-symmetrical, or not to be fully mirror-symmetrical.

The movement of the pull-out furniture part 1 during the pulling-out operation is at least essentially linear, it being possible, in order to compensate for downward movement as a result of flexing of guide rails under load and/or in order to generate gravity-controlled retraction, for a slightly curved deviation from the linear movement of the rails to take place.

A respective pull-out guide 3, 4 comprises a basic-structure-mounted guide rail 6, which is to be fastened on the basic furniture structure 2, a first guide rail 7, which is mounted such that it can be displaced in and counter to the pull-out direction in relation to the basic-structure-mounted guide rail 6, and a second guide rail 8, which is mounted such that it can be displaced in and counter to the pull-out direction in relation to the first guide rail 7. In the exemplary embodiment, the first guide rail 7 is thus a center rail of the pull-out guide and the second guide rail 8 is a drawer rail, which is to be fastened on the pull-out furniture part 1.

In the exemplary embodiment, the pull-out guide is designed in the form of a roller-action pull-out mechanism. In the case of roller-action pull-out mechanisms, the guide rails are guided such that they can be displaced in relation to one another by means of running rollers mounted on at least one of the guide rails such that they can be rotated about axes. These running rollers are thus load-transmitting running rollers, i.e. some of the weight of the pull-out furniture part 1 is transmitted by the respective running roller. In particular, the running rollers are mounted such that they can be rotated about horizontal axes.

The figures illustrate specifically a differential pull-out mechanism, in the case of which all the running rollers 9-12 are mounted in a rotatable manner on a basic profile 13 of the center rail. In the case of differential pull-out mechanisms, the guide rails run synchronously when the pull-out guide is pulled out, the center rail moving at half the speed of the drawer rail. The invention, however, is not restricted to this specific type of pull-out guide. For example, the invention could also be used for roller-action pull-out mechanisms in the manner of telescopic pull-out mechanisms, in the case of which the drawer and center rails are pulled out one after the other. The invention could also be used for pull-out guides other than roller-action pull-out mechanisms. It would thus be possible for the pull-out guide to be designed, for example, in the form of a ball-controlled pull-out mechanism or, generally, in the form of a pull-out mechanism with rolling-contact bodies arranged in carriages which can be displaced in relation to the guide rails. Likewise possible is use in mixed designs (having running rollers mounted in a rotatable manner on the rails and rolling-contact bodies arranged in carriages).

The possible arrangements of the running rollers 9-12 and of the guide-rail running tracks interacting therewith will thus not be explained in detail here. All that need be mentioned is that, in the case of the design shown in the form of a differential pull-out mechanisms, a running roller 12 is mounted in a rotatable manner with an amount of play in the central region of the first guide rail 7, which forms the center rail, and said running roller runs between running tracks of the first guide rail 7 and of the basic-structure-mounted guide rail 6 and transmits a load directly from the first guide rail 7 to the basic-structure-mounted guide rail 6. This running roller 12 is also referred to as a differential roller.

Two lateral-guidance units 14, which are spaced apart in the pull-out direction 5, are retained on the basic profile 13 of the first guide rail 7 of the respective pull-out guide. A respective lateral-guidance unit 14 has a lateral-guidance part 15 designed in the form of a roller. The lateral-guidance part 15, which is designed in the form of a roller, is mounted on a carrying part 17 of the lateral-guidance unit 14 such that it can be rotated about an axis 16. The axis 16 is oriented at right angles to the pull-out direction 5 and at right angles to the transverse direction 50, that is to say, in the exemplary embodiment, vertically.

In the exemplary embodiment, the lateral-guidance units 14 are retained in a U-shaped portion of the basic profile 13 of the first guide rail 7. Other designs of the first guide rail and/or other arrangements of the lateral-guidance units 14 are conceivable, and possible, in other exemplary embodiments.

In the exemplary embodiment, the carrying part 17 is designed in the manner of an eccentric. For this purpose, it is arranged such that it can be rotated about an axis of rotation 18 and the axis 16 is at a distance from the axis of rotation 18. When the carrying part 17 is rotated about the axis of rotation 18, the position of the axis 16, and thus the position of the lateral-guidance part 15, is adjusted in relation to the transverse direction 50.

A respective lateral-guidance unit 14 has a locking device 19, which can be opened and closed. In the opened state of the locking device 19, the carrying part 17 can be rotated about the axis of rotation 18. In the closed state of the locking device 19, the rotary position of the carrying part 17 in relation to the axis of rotation 18 is fixed, as is thus the position of the lateral-guidance unit part 15 in relation to the transverse direction 50.

The locking device 19 has a clamping part 20, which in the exemplary embodiment is mounted on the basic profile 13 of the first guide rail 7 such that it can be pivoted about a pivot axis 21. For example, it is possible, for this purpose, for an axial pin 22 to be inserted into bores in opposite crosspieces of the U-shaped portion of the basic profile 13, in which the lateral-guidance unit 14 is arranged.

Figure 9:
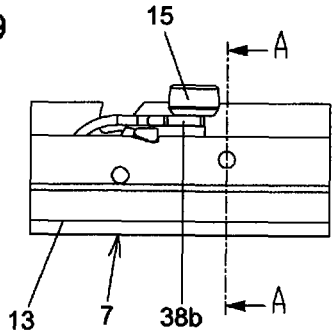
FIG. 9 shows a side view of a portion of the first guide rail with the lateral-guidance unit installed.
Figure 10:
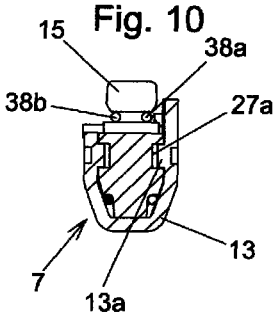
FIG. 10 shows a section along line AA from FIG. 9.
Figure 11:
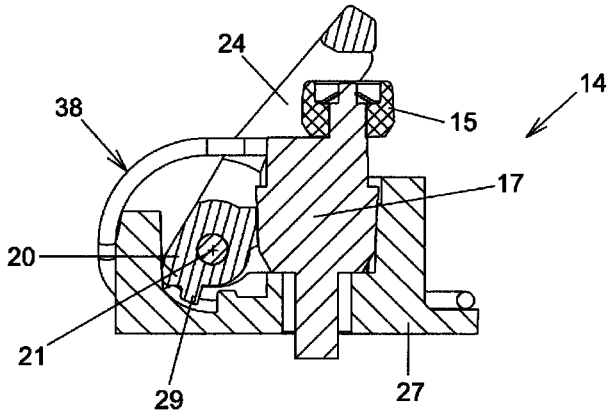
FIGS. 11 and 12 show longitudinal sections taken through the center of the lateral-guidance unit in the closed and open states of the locking device.

The clamping part 20 has fitted on it an actuating element 23 which is in the form of a lever and by means of which the clamping part 20 can be pivoted about the pivot axis 21. In the exemplary embodiment, in the case of the front (as seen in the pull-out direction 5) of the two lateral-guidance units 14 fitted on the basic profile 13 of a respective first guide rail 7, the clamping part 20 also has fitted on it a further lever 24, of which the function will be explained hereinbelow. This further lever 24 can be dispensed with in the case of the lateral-guidance unit 14 which is arranged further to the rear. Otherwise, the front and the rear lateral-guidance units 14 are of identical design. One of the front lateral-guidance units 14 is illustrated in detail in particular in FIGS. 6-8, 11-12 and 20-21. The arrangement of one of the rear lateral-guidance units 14 is shown in FIGS. 9 and 10, the arrangement of the respective front lateral-guidance unit 14 being fully analogous to this.

When the actuating element 23 is adjusted from an open position (cf., in particular, FIG. 6 and FIG. 20) into a closed position (cf., in particular, FIGS. 13-15 and FIG. 21), that is to say, in the exemplary embodiment, is pivoted about the pivot axis 21, then engagement surfaces 25, 26 of the clamping part 20 and carrying part 17, which are spaced apart from one another in the open position of the actuating element 23, come into engagement. For example, the engagement surfaces 25, 26 may be designed in the form of toothing formations or ribbing formations.

In the exemplary embodiment illustrated in FIGS. 1 to 24, the locking device 19 further comprises a mating clamping part 27. The latter can be displaced parallel to the pull-out direction 5 in relation to the basic profile 13. When the actuating element 23 is adjusted from the open position into the closed position, a cam formation 28 of the clamping part 20 (depicted in FIGS. 6-8) runs onto the mating clamping part 27 and displaces the mating clamping part 27 in relation to the basic profile 13 of the first guide rail 7, in order to push it onto the carrying part 17 on the opposite side of the clamping part 20. The carrying part 17 is thus clamped, in the closed state of the locking device 19, between the clamping part 20 and the mating clamping part 27. The clamping forces here need not be transmitted via the basic profile 13 of the first guide rail 7.

Figure 12:
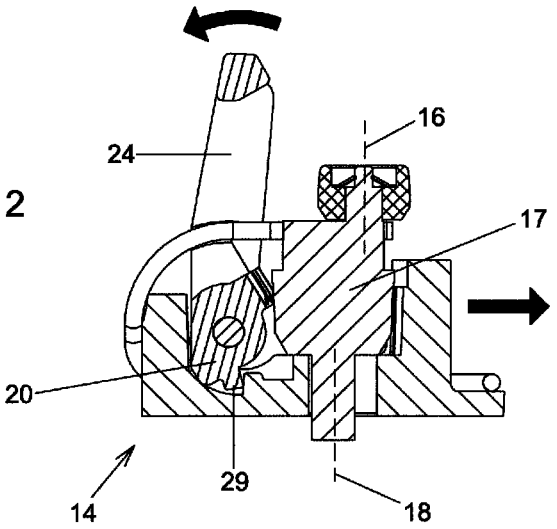

When the locking device 19 is opened, a cam formation 29 (cf. FIGS. 11 and 12) of the clamping part 20 pushes the mating clamping part 27 in the direction opposite to that for closure of the locking device, cf. FIG. 12.

In the exemplary embodiment, the mating clamping part 27 is retained in the basic profile 13 by means of protuberances 13*a* of the basic profile, said protuberances engaging in depressions 27*a* of the mating clamping part 27.

In order for the carrying part 17 to be mounted such that it can be rotated about the axis of rotation 18, in the exemplary embodiment, a stub 17*a* of the carrying part 17 projects through a slot 27*b* of the mating clamping part 27 into an opening in the basic profile 13.

As can be seen, in particular, from FIG. 3, a respective lateral-guidance part 15 interacts with two lateral-guidance surfaces 30, 31 of the second guide rail 8, said surfaces, as seen in an end-side view (parallel to the pull-out direction 5), being located on either side of the lateral-guidance part 15. The lateral-guidance surfaces 30, 31 are thus spaced apart from one another in the transverse direction 50. The distance in the transverse direction here is somewhat greater than the diameter of the lateral-guidance part 15, for example greater by 0.05 mm-0.3 mm. The lateral-guidance surfaces 30, 31 extend in a longitudinal direction located parallel to the pull-out direction 5. The lateral-guidance surfaces 30, 31 are preferably of planar design and are located in a plane located parallel to the pull-out direction 5. It is possible for the lateral-guidance surfaces 30, 31 to be located parallel to one another or to enclose an angle in relation to one another (parallel to the pull-out direction 5 as seen in an end-side view) of no greater than 60°, particularly preferably no greater than 20°. An advantageous angle may range from 2° to 20°.

The roller forming the lateral-guidance part 15 may be, in particular, curved convexly, cylindrical, conical or preferably conically convex on its circumference.

In the exemplary embodiment shown, the lateral-guidance surfaces 30, 31 are formed by the opposite limbs of a U-shaped portion of the second guide rail 8. The U-shaped portion here is open in the downward direction and the base crosspiece of the U-shaped portion advantageously forms, on its underside, a running surface for at least one running roller of the pull-out guide, in the exemplary embodiment for the running rollers 9, 12.

Figure 19:
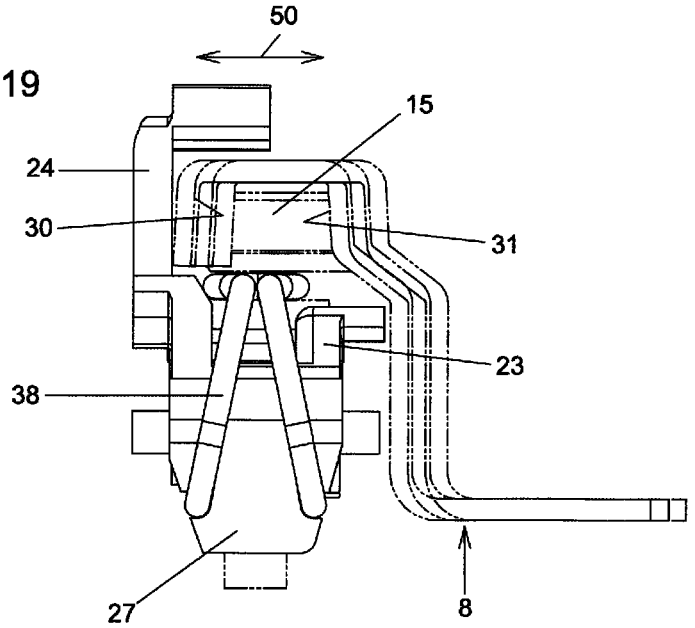
FIG. 19 shows an end-side view of the lateral-guidance unit corresponding to FIGS. 17 and 18 together with the second guide rail, wherein the different positions of the second guide rail are illustrated by dashed lines in dependence on the possible positions of the lateral-guidance part.

If the lateral-guidance part 15 is adjusted in position in relation to the transverse direction 50, then the second guide rail 8 is carried along, to be precise, since the lateral-guidance part 15 interacts with the lateral-guidance surfaces 30, 31 arranged on either side of it, in both transverse directions 50, or, in other words, in the two opposite directions parallel to the transverse direction 50. FIG. 19 illustrates the different carried-along positions of the second guide rail 8 in dependence on the position of the lateral-guidance part 15 in relation to the transverse direction 50. The second guide rail 8, in the respective position, has only a small amount of play in the two transverse directions 50, corresponding to the amount of play between the lateral-guidance part 15 and the two lateral-guidance surfaces 30, 31 as seen in the transverse direction 50.

As already mentioned, this small amount of play in the two transverse directions 50 is present over at least 50% of the pull-out path, preferably over at least 80% of the pull-out path. In particular following the fully pushed-together state of the pull-out guide, it is possible to form a portion of the pull-out path with a larger amount of play between the lateral-guidance part 15 and the lateral-guidance surfaces 30, 31 or the at least one of the lateral-guidance surfaces 30, 31 or both lateral-guidance surfaces 30, 31 can be removed from this portion of the pull-out path.

Figure 13:
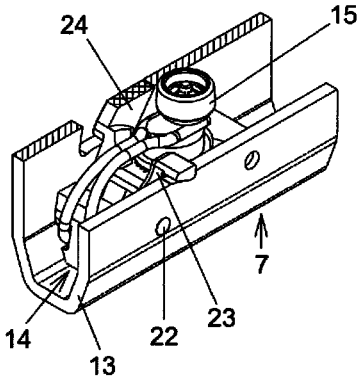
FIGS. 13 and 14 show perspective views of a portion of the first guide rail with the lateral-guidance unit installed, wherein the lever of the lateral-guidance unit which forms the disengagement-prevention means has been partially cut away; the views showing the closed state of the locking device and different positions of the lateral-guidance part.
Figure 15:
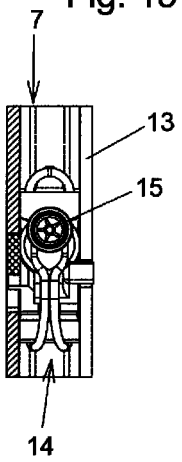
FIGS. 15 and 16 show plan views of the items from FIGS. 13 and 14.
Figure 14:
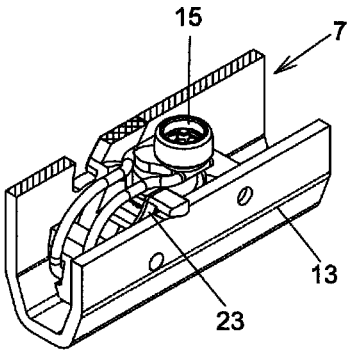
Figure 16:
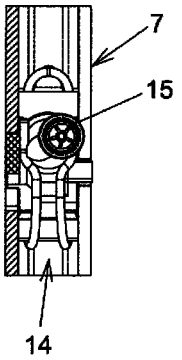
Figure 17:
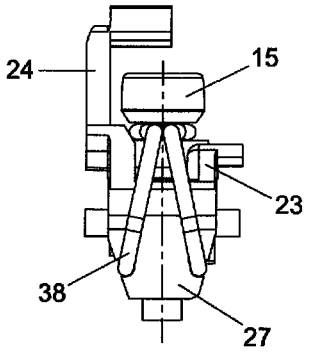
FIGS. 17 and 18 show end-side illustrations of the lateral-guidance unit in the closed state of the locking device, the lateral-guidance part being in different positions in each case.
Figure 18:
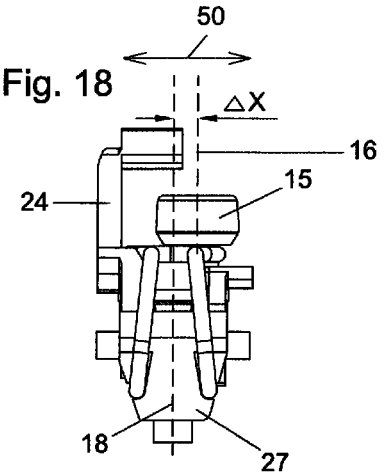

FIGS. 13, 15 and 17 show the center position of the lateral-guidance part 15, and FIGS. 14, 16 and 18 show the lateral-guidance part 15 in a position in which it has been adjusted by Ax in the transverse direction 50 in relation to the center position.

The pull-out guides 3, 4 are designed with only a small amount of lateral play (=amount of play as seen in the transverse direction 50) between the basic-structure-mounted guide rail 6 and the first guide rail 7. This amount of play is preferably less than 0.5 mm, particularly preferably less than 0.2 mm. Elements which are prestressed in relation to one another also make it possible for the guidance between the basic-structure-mounted guide rail 6 and the first guide rail 7 to be completely free of play.

For the operation of installing the pull-out furniture part 1 in the basic furniture structure 2, first of all the basic-structure-mounted guide rails 6 are mounted on the basic furniture structure 2. The first guide rails 7 here have already been inserted into the basic-structure-mounted guide rails 6, or are inserted into the same thereafter. The second guide rails 8 are installed on the pull-out furniture part 1 in the state in which they are separated from the first guide rails 7. The second guide rails 8, installed on the pull-out furniture part 1, are then inserted into the first guide rail 7 in the open state of the locking devices 19 of the lateral-guidance units 14. The lateral-guidance parts 15 here are moved in between the lateral-guidance surfaces 30, 31. Depending on the specific dimensions present in the respective case, the lateral-guidance parts 15 adjust themselves automatically in position in relation to the transverse direction 50 by the interaction with the lateral-guidance surfaces 30, 31. Once the locking devices 19 have been closed, the positions of the lateral-guidance parts 15 in relation to the transverse direction 50 are fixed. The small amount of play present between the lateral-guidance parts 15 and the lateral-guidance surfaces 30, 31 and also between the basic-structure-mounted guide rail 6 and the first guide rail 7 gives rise, overall, to a very small amount of play for the pull-out guides 3, 4 as seen in the transverse direction 50.

Figure 20:
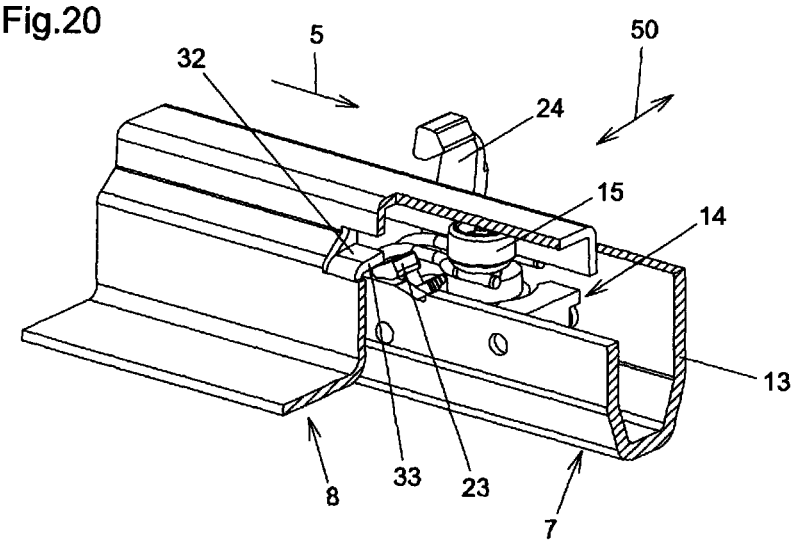
FIG. 20 shows a portion of the first guide rail with the locking unit installed, and in the open state of the locking device, together with a portion of the second guide rail with the stop surface running onto the actuating element.
Figure 21:
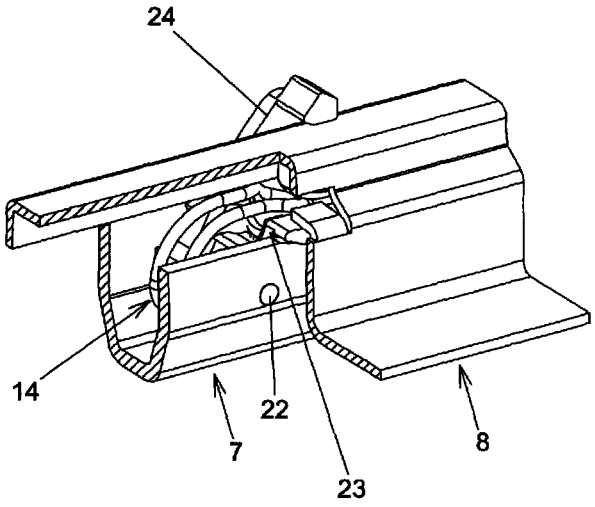
FIG. 21 shows an illustration of the items from FIG. 20 as seen from a different viewing direction and once the actuating element has been adjusted into the closed position.
Figure 22:
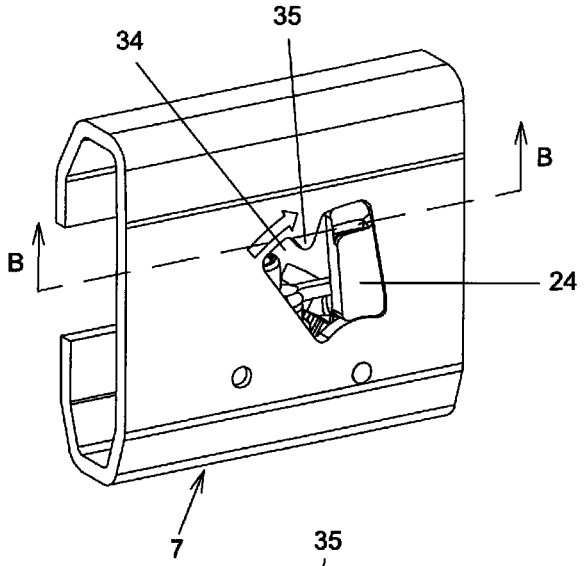
FIGS. 22 and 23 show portions of the first guide rail with the lateral-guidance unit installed, in the open and closed states of the locking device.

The locking device 19 of the respective lateral-guidance unit 14 is closed preferably automatically the first time the second guide rail 8 is pushed into the first guide rail 7. This closing operation of the locking device 19 is illustrated in FIGS. 20 and 21. When the second guide rail 8 is pushed in counter to the pull-out direction 5, a stop surface 33, which, in the exemplary embodiment, is arranged on a lug 32 which has been punched out of the basic profile of the second guide rail 8 and bent over, runs onto the lever-design actuating element 23 of the locking device 19, cf. FIG. 20. As the pushing-in operation continues, the lever forming the actuating element 23 is pivoted from its open position into its closed position by the pressure exerted on it by the stop surface 33. When the closed position of the actuating element 23 has been reached, the stop surface 33 passes out of engagement with the actuating element 23 and the lug 32 can be displaced over the actuating element 23, cf. FIG. 21.

It would also be possible for the stop surface 33 to be designed in some other way, for example arranged on a part which is fastened on the basic profile of the second guide rail 8.

Instead of an actuating element 23 designed in the form of a lever, it would also be possible, depending on the design of the locking device 19, to provide some other actuating element 23, for example an actuating element which can be displaced linearly between an open position and a closed position.

In the exemplary embodiment, in the case of the front of the two lateral-guidance units 14 of the first guide rail 7 of the respective pull-out guide 3, 4, the clamping part 20 has fitted on it a further lever 24, which, when the actuating element 23 is pivoted about the pivot axis 21, is likewise pivoted about the pivot axis 21. In the closed position of the actuating element 23, that is to say in the closed state of the locking device 19, an end portion which follows the free end of the lever 24, and is angled in a direction located parallel to the transverse direction 50 in relation to the rest of the lever 24, assumes a position in which it acts as a disengagement-prevention means for the second guide rail 8. In this position, the angled end portion of the lever 24 is located so closely above the basic profile of the second guide rail 8 that the latter cannot be raised upward to the extent where a stop (not illustrated in the Figures) can be guided past the running rollers 9-12 of the first guide rail 7.

Figure 23:
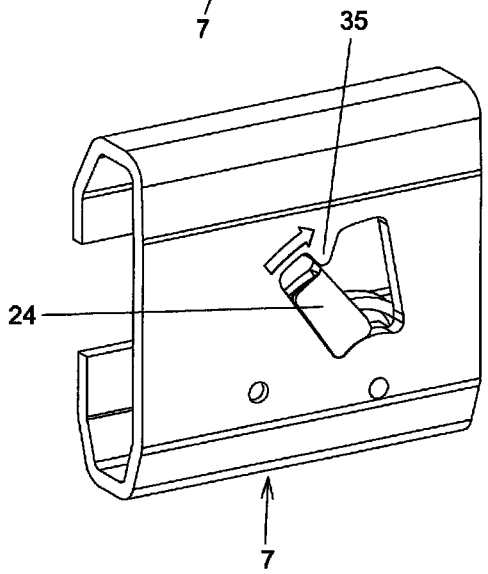
Figure 24:
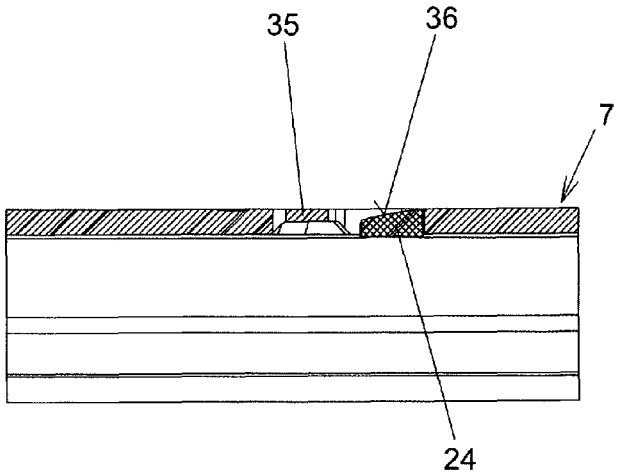
FIG. 24 shows a section along line BB from FIG. 22.

In the closed position of the actuating element 23, in the exemplary embodiment, a latching portion of the lever 24 snaps into a latching aperture 34 of the first guide rail 7, said latching aperture 34 being delimited by a latching protrusion 35, cf. FIG. 23. When the actuating element 23 is adjusted from the open position into the closed position, the latching portion of the lever 24 can travel over the latching protrusion 35 by means of a run-in slope 36 (cf. FIG. 24). The disengagement-prevention means is thus fixed. If the second guide rail 8 is to be removed, the latching portion of the lever 24 is pushed in and guided into the latching aperture 37 via the latching protrusion 35.

A disengagement-prevention means for the second guide rail 8 could also be designed in a manner other than by a lever 24 fitted on the clamping part 20, for example by a part which is independent of the lateral-guidance unit 14. It is then also possible for the lever 24 to be dispensed with. On the other hand, it would likewise be possible, in the case of the rear lateral-guidance units 14, to provide a lever 24 without an angled end portion located parallel to the transverse direction 50, said lever, in the closed position, being snapped into a latching aperture 34 of the first guide rail 7 in a manner analogous to the lever 24 and being openable in a manner analogous to that described for the lever 24. This makes it possible to secure the closed state of the locking device. If the front lateral-guidance units 14 are not to act, at the same time, as a disengagement-prevention means, it would also be possible for the levers 24 to be designed in this way.

The actuating element 23 could also be designed, at the same time, as a disengagement-prevention means.

In the open state of the locking device 19, the lateral-guidance part 15, if there is no external force acting on it, is retained in a center position, in relation to its possible adjustment in the transverse direction 50, by a spring 38. The spring 38, for this purpose, has first and second spring legs 38*a*, 38*b*, which butt against either side of the carrying part 17 as seen in the transverse direction 50. The two spring legs 38*a*, 38*b* are connected to one another by a U-shaped portion 38*c*. The spring 38 is retained on the mating clamping part 27.

The lateral-guidance part 15 could also be retained by at least one spring in a starting position other than the central position in relation to the possible adjustment range in the transverse direction 50.

If the pull-out guides 3, 4, which are arranged on either side of the pull-out furniture part 1, each have at least one lateral-guidance unit 14 with a lateral-guidance part 15 which, in the open state of the locking device 19, is retained in a center position by at least one spring 38, the pull-out furniture part 1 will adjust itself automatically into a center position in relation to the basic furniture structure 2, as seen in the transverse direction 50, when the second guide rail 8 is pushed into the first guide rail 7. It is also possible, however, for the user to achieve an eccentric position of the pull-out furniture part 1 by virtue of lateral pressure being applied during the pushing-in operation.

In an advantageous embodiment of the invention, a respective pull-out guide 3, 4, as already described, has at least two lateral-guidance units 14, which are designed in a manner described and are spaced apart from one another, as seen in the pull-out direction 5, on the first guide rail 7. In the exemplary embodiment, each pull-out guide 3, 4 has a lateral-guidance unit 14, which is arranged in the region of the front end (as seen in the pull-out direction 5), and a lateral-guidance unit 14, which is arranged in a center portion of the first guide rail 7, cf. in particular, FIG. 2.

It would also be conceivable, and possible, however for just one lateral-guidance unit 14, or more than two lateral-guidance units 14 to be arranged in a respective pull-out guide 3, 4. The pull-out guides 3, 4 could also have different numbers of lateral-guidance units. For example, it would be possible for one of the pull-out guides 3, 4 to have just have one lateral-guidance unit 14 and for the other of the pull-out guides 3, 4 to have two or more lateral-guidance units 14.

Provision can also be made for just one of the pull-out guides 3, 4 to have one, two or more than two lateral-guidance units 14.

Although it is preferred for a respective lateral-guidance part 15 to interact with lateral-guidance surfaces 30, 31 located on either side of the lateral-guidance part 15, such a design is not imperative. For example, it would be possible for the lateral-guidance part 15 of the at least one lateral-guidance unit 14 of the one pull-out guide 3 to interact just with one lateral-guidance surface 30, which delimits an amount of play of the second guide rail 8 in relation to the first guide rail 7 in a first direction parallel to the transverse direction 50, and for the lateral-guidance part 15 of the at least one lateral-guidance unit 14 of the other pull-out guide 4, which is arranged on the other side of the pull-out furniture part 1, to interact with a lateral-guidance surface 31, which delimits an amount of play of the second guide rail 8 in relation to the first guide rail 7 in the opposite direction parallel to the transverse direction 50. It is advantageously the case here that the lateral-guidance parts, in the open state of the locking device and without any external force acting on the respective lateral-guidance part, are retained by in each case at least one spring in a starting position, in which they are adjusted, in relation to their position in the transverse direction 50, to the furthest extent in the direction in which is located the lateral-guidance surface 30, 31 interacting therewith.

In the previously described exemplary embodiment, the carrying part 17 is designed in the form of an eccentric. Instead, it would also be possible, for example, for the carrying part 17 to be mounted such that it can be displaced linearly parallel to the transverse direction 50, wherein such displacement is possible in the open state of the locking device 19 and the carrying part 17 is clamped firmly in its adjusted displacement position in the closed state of the locking device 19.

In order to open and close a locking device 19, it would also be possible for a clamping part 20 to be pivoted about an axis other than one located parallel to the transverse direction 50. A locking device could also be opened and closed by virtue of a clamping part being displaced linearly.

The first guide rail, which has the at least one lateral-guidance unit 14, could also be the pull-out guide rail (also referred to as the drawer rail), which is to be fitted on the pull-out furniture part 1. The second guide rail, which has the at least one lateral-guidance surface, could then be the center rail. The design in respect of the arrangement of the lateral-guidance units 14 and lateral-guidance surfaces 30, 31 is thus the reverse of the arrangement described above.

The invention, however, can also be used for pull-out guides with just two guide rails. One of the two guide rails, that is to say the basic-structure-mounted guide rail or the guide rail which can be pulled out of the same, would then have the at least one lateral-guidance unit 14 and, in accordance with the terminology used in the present document, would thus constitute the first guide rail, whereas the other of the two guide rails would have the at least one lateral-guidance surface and would thus constitute the second guide rail.

Modified exemplary embodiments will be described hereinbelow with reference to the FIGS. 25 to 44. An explanation will be given in each case of the differences from the embodiment described with reference to FIGS. 1 to 24. With the exception of the differences described, the design corresponds to that of the first exemplary embodiment and the description relating to the first exemplary embodiment, including possible modifications described, likewise applies. For identical, or at least analogous, items, use has been made in particular of the same designations, and designations used in the description and not depicted in FIGS. 25 to 44 relate to the analogous parts which are depicted in FIGS. 1 to 24.

Figure 25:
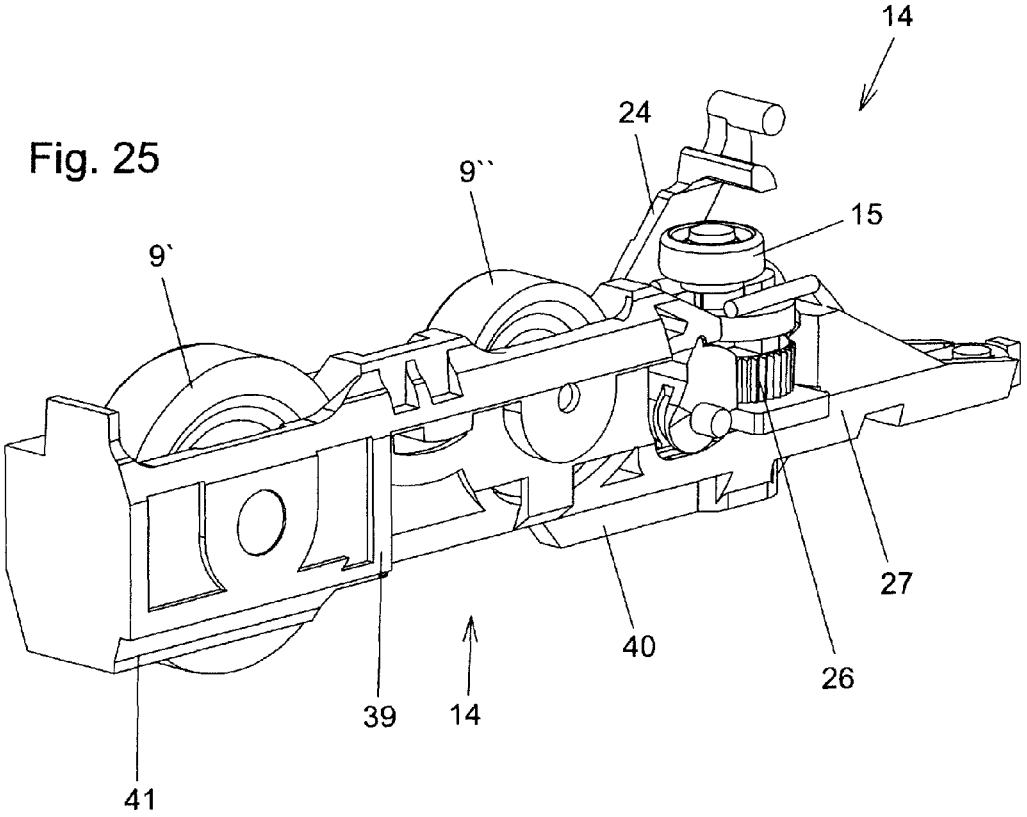
FIG. 25 shows a second exemplary embodiment of the lateral-guidance unit, with integrated running rollers, of the pull-out guide.
Figure 26:
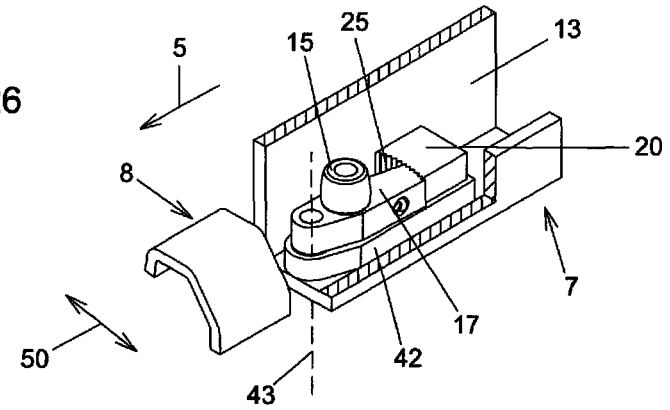
FIG. 26 shows a perspective view of a simplified illustration of a portion of the first guide rail with the lateral-guidance unit installed and of a portion of the second guide rail, according to a third exemplary embodiment of the invention.
Figure 27:
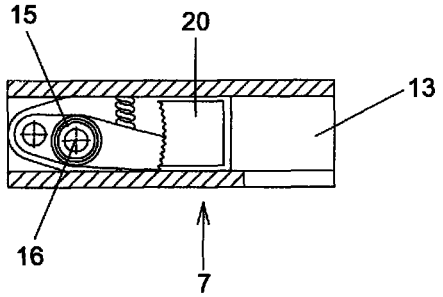
FIG. 27 shows a plan view of the portion of the first guide rail with the lateral-guidance unit installed from FIG. 26.
Figure 28:
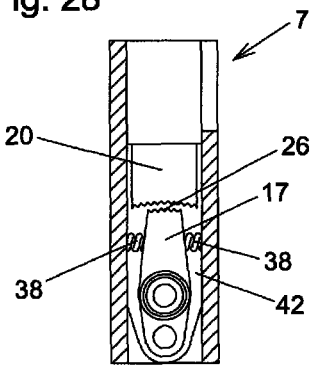
FIG. 28 shows a plan view analogous to FIG. 27 in the open state of the locking device.
Figure 29:
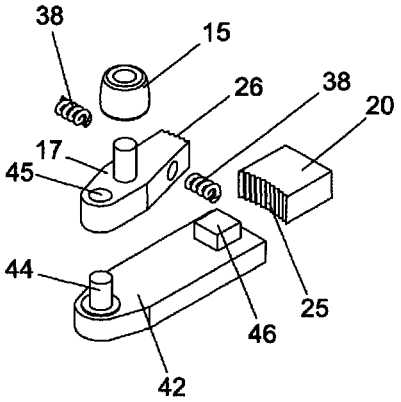
FIG. 29 shows an exploded illustration of the lateral-guidance unit.

In the case of that embodiment of a lateral-guidance unit which is illustrated in FIG. 25, running rollers 9', 9" are integrated in the lateral-guidance unit 14. This may be, in particular, a lateral-guidance unit 14 which is arranged in the region of the front end of the first guide rail 7. It is also possible for a lateral-guidance unit 14 without any integrated running rollers to be used in a region located further to the rear of the first guide rail. The running rollers 9', 9" are load-transmitting running rollers, i.e., some of the weight of the pull-out furniture part 1 is transmitted thereby. In particular, the running rollers 9', 9" are mounted such that they can be rotated about horizontal axes.

In order to mount the running rollers 9', 9" in a rotatable manner, use is made of a bearing portion 39 of the lateral-guidance unit 14, said bearing portion, in this case, being formed in one piece with the mating clamping part 27.

The actuating element 23 which is shown in the first exemplary embodiment, and serves for closing the locking device 19 by virtue of the stop surface 33 of the second guide rail 8 running thereon when the second guide rail 8 is pushed in, is not present here and, in this case, the lever 24 serves as actuating element for opening and closing the locking device 19. An additional lever corresponding to the actuating element 23 of the first exemplary embodiment could, however, be present. Conversely, it would also be possible for the first exemplary embodiment to dispense with the actuating element 23 and for the lever 24 to form an actuating element for opening and closing the locking device.

FIG. 25 also illustrates projecting crosspieces 40, 41 of the bearing portion 39, said crosspieces engaging in apertures in the basic profile 13 of the first guide rail 7. When the locking device 19 is opened and closed, once again displacement of the mating clamping part 27 takes place, in this case together with the bearing portion 39, in relation to the basic profile 13 of the first guide rail 7 parallel to the pull-out direction 5.

A third exemplary embodiment of the invention is illustrated in FIGS. 26 to 29. The carrying part 17, which carries the lateral-guidance part 15 (the lateral-guidance part 15 is preferably, once again, a roller mounted by the carrying part 17 such that it can be rotated about an axis 16), is mounted here by a bearing part 42 such that it can be pivoted about a pivot axis 43. For example an axial pin 44 of the bearing part 42 engages, for this purpose, in an axial aperture 45 of the carrying part 17. The pivot axis 43 is located, in particular, vertically.

The bearing part 42 is connected rigidly to the basic profile 13 of the first guide rail 7 by way of fastening means (not illustrated).

At one end (as seen in the pull-out direction 5), the carrying part 17 has an engagement surface 25, which interacts with the engagement surface 26 of a clamping part 20 in the closed state of the locking device. The engagement surfaces 25, 26 may be, in particular, toothing formations or ribbing formations.

In order to open and close the locking device, the clamping part 20, in this exemplary embodiment, is displaced parallel to the pull-out direction 5 in relation to the bearing part 42. The clamping part 20 is guided in a displaceable manner by a guide protrusion 46 of the bearing part 42, said guide protrusion engaging in an aperture of the clamping part 20. For the sake of simplicity, the means for adjusting the clamping part 20 in relation to the bearing part 42 in order to open and close the locking device 19 are not illustrated here.

The actuating element provided here could be, for example, a lever which can be pivoted about a horizontal axis and has a cam formation engaging in an aperture of the clamping part 20.

A further possible design could consist in providing a spring which prestresses the clamping part 20 into the position in which the engagement surfaces 25, 26 are in engagement (not illustrated in the Figures). In order to open the locking device, an actuating element could displace the clamping part 20 counter to the force of this spring, in which case the engagement surfaces 25, 26 are spaced apart from one another. It would be possible, for example, for the actuating element to have a stop surface which, when the second guide rail 8 is pushed in, runs onto a stop surface provided on the second guide rail. It would thus be possible, when the lateral-guidance part 15 is moved in between the lateral-guidance surfaces 30, 31, located preferably on either side of the second guide part 15, for the locking device 19 to be opened automatically, wherein, when the pushing-in operation of the second guide rail 8 continues, the clamping part 20 is freed again and the locking device 19 closes automatically. Such a design could also be provided in all the other embodiments described.

So that, in the open state of the locking device 19, when there is no external force acting on the clamping part 20, the clamping part 20 can be retained in a preferably central starting position, springs 38 designed in the form of helical springs are provided here. These springs project into blind bores arranged on either side of the clamping part 20 and are supported on the basic profile 13 of the first guide rail 7. It should also be possible for the at least one spring provided, in order to retain the clamping part 20 in the starting position, to be designed, or arranged, in some other way.

A fourth exemplary embodiment of the invention is illustrated in a simplified manner in FIGS. 30 to 32. The carrying part 17 here is designed, once again, in the form of an eccentric, in a manner similar to the first exemplary embodiment. This eccentric is mounted such that it can be rotated about a vertical pivot axis 21 by an axial pin (not visible in FIGS. 30-32) engaging in the base profile 13 of the first guide rail 7. In the closed state of the locking device, the engagement surface 26 of the clamping part 20 interacts with the lateral surface of the eccentric, said lateral surface acting as the engagement surface 25. In order to open and close the locking device 19, the clamping part 20, in a manner analogous to the third exemplary embodiment, can be displaced parallel to the pull-out direction 5 in relation to the base profile 13 of the first guide rail 7. The displaceable mounting of the clamping part 20 is not illustrated in detail. As far as the adjustment of the clamping part 20 in relation to the carrying part 17, in order to open and to close the locking device 19, is concerned, reference is made to the description of the third exemplary embodiment.

The engagement surfaces 25, 26 are formed here by a plastics material with a high coefficient of friction. The carrying part 17 is locked, in the closed state of the locking device 19, in a frictionally fitting manner.

It would also be possible, in the case of the other exemplary embodiments described, to provide frictionally fitting locking of the clamping part 20 in the closed state of the locking device. Conversely, it would also be possible for the fourth exemplary embodiment to have form-fitting locking of the clamping part 20 in the closed state of the locking device. Engagement surfaces 25, 26 which interact both in a frictionally fitting manner and in a form-fitting manner are also conceivable and possible.

Figure 34:
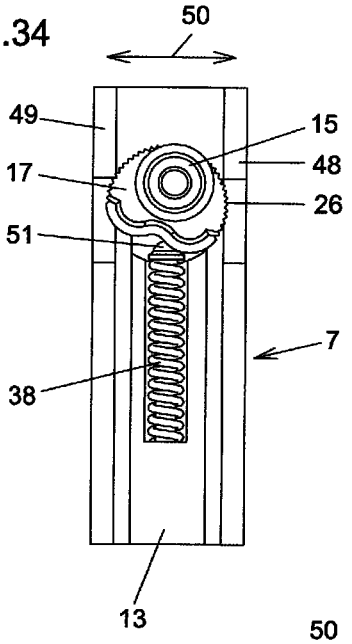
FIG. 34 shows a plan view of a portion of the first guide rail with the lateral-guidance unit installed, in the closed state of the locking device.
Figure 35:
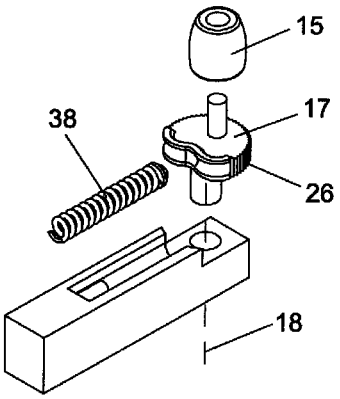
FIG. 35 shows an exploded illustration.

A fifth exemplary embodiment of the invention is illustrated in FIGS. 33 to 35. The carrying part 17, once again, is designed in the form of an eccentric. The latter is mounted, in this case, on a bearing part 47 such that it can be rotated about the axis of rotation 18. The axis of rotation 18, once again, runs, in particular, vertically. In order to open and close the locking device, the bearing part 47 can be displaced parallel to the pull-out direction 5 in relation to the basic profile 13 of the first guide rail 7. For the sake of simplicity, once again, the parts which serve for displacing the bearing part 47 are not illustrated. The displacement can be achieved in a manner analogous to the displacement of the bearing part 42 in the third exemplary embodiment, and reference is made to the relevant description.

In the closed state of the locking device 19, in this case the engagement surface 25 of the carrying part 17 is pressed against edges of crosspieces 48, 49 of the basic profile 13 of the first guide rail 7. These edges are formed by apertures in the crosspieces 48, 49 and the surfaces of the crosspieces 48, 49 in the region of these edges form engagement surfaces which interact with the engagement surface 25 of the carrying part 17 and are intended for locking the carrying part 17 in the closed state of the locking device 19. A separate clamping part can thus be dispensed with in this exemplary embodiment. In order for the carrying part 17 to be clamped in a closed state of the locking device, said carrying part interacts with clamping portions of the basic profile 13 of the first guide rail 7, said clamping portions being formed by portions of the crosspieces 48, 49 in the region of the aforementioned edges. Such clamping portions of the basic profile 13 could also be designed, specifically, in some other way, for example by deformed portions of the crosspieces 48, 49.

In order for the lateral-guidance part 15, which is carried by the carrying part 17, to be retained in a, preferably central, starting position in the open state of the locking device 19, without any external force being active, use is made of a spring 38 with a sliding piece 51 which is fitted thereon and, in the starting position of the lateral-guidance part 15, pushes into a hollow of the carrying part 17. When the carrying part 17 is rotated, the sliding piece 51 is moved to a greater or lesser extent out of the hollow and slides along portions of the surface of the carrying part 17 which adjoin the hollow, the spring 38 being compressed to an increasing extent as the rotation of the carrying part 17 increases.

Figure 36:
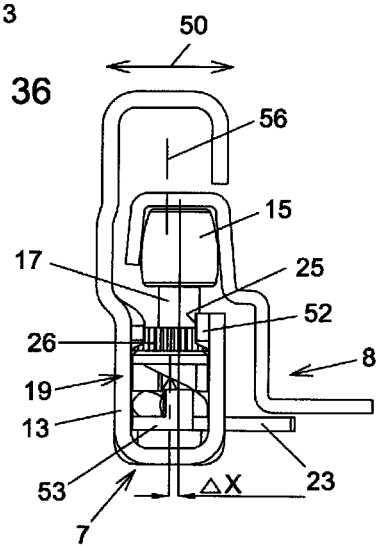
FIG. 36 shows an end-side view of the first and second guide rails (without guide rollers) according to a sixth exemplary embodiment of the invention.
Figure 37:
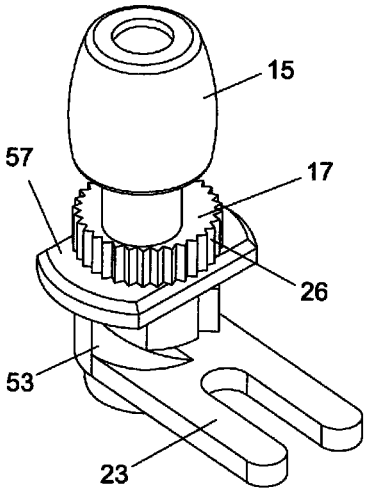
FIG. 37 shows a perspective view of the lateral-guidance unit.
Figure 38:
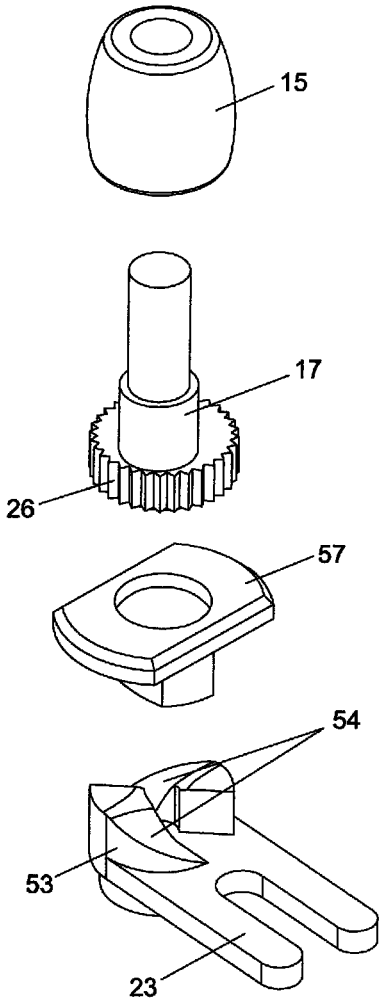
FIG. 38 shows an exploded illustration of the lateral-guidance unit.
Figure 43:
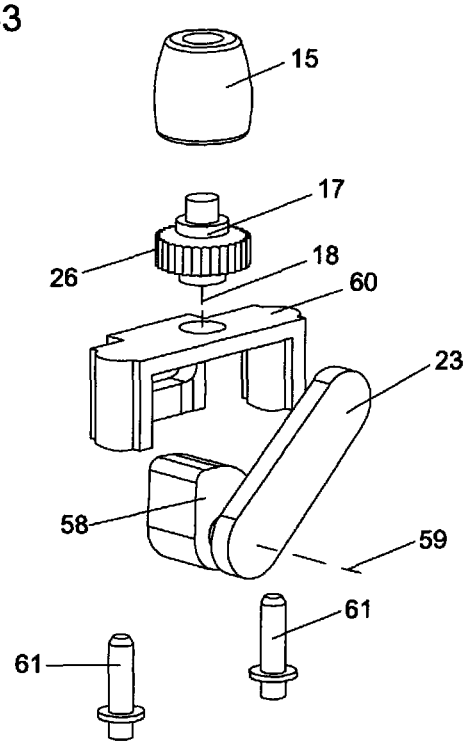
FIG. 43 shows a side view of the lateral-guidance unit.
Figure 44:
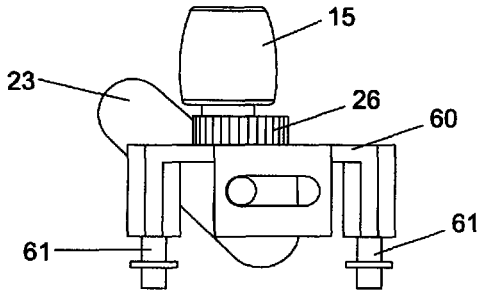
FIG. 44 shows an exploded illustration of the lateral-guidance unit.

A sixth exemplary embodiment of the invention is illustrated in FIGS. 36 to 38. The carrying part 17, once again, is designed in the form of an eccentric. When the locking device 19 is opened and closed, it is adjusted in a direction located at right angles to the transverse direction 50 and at right angles to the pull-out direction 5, that is to say in a vertical direction in the exemplary embodiment, so that engagement surfaces 25, 26 of the carrying part 17 and of a clamping portion 52 of the basic profile 13 of the first guide rail 7 are brought into engagement in the closed state of the locking device 19 and are spaced apart from one another in the open state of the locking device 19. The clamping portion 52 is formed by virtue of a portion of the basic profile 13 being deformed. It should also be possible to provide, instead, a clamping part secured on the basic profile 13.

In order to displace the carrying part 17 when the locking device 19 is opened and closed, use is made of a control part 53, on which is arranged the actuating element 23 in the form of a lever. The control part 53 has at least one screw surface 54, which interacts with a screw surface 55 of a guidance part 57. The screw surfaces 54, 55 extend around the pivot axis 56, about which the control part 53 is rotated by means of the actuating element 23 in order for the locking device 19 to be opened and closed. The guidance part 57 is mounted such that it can be displaced in relation to the basic profile 13 in the direction in which the carrying part 17 is adjusted when the locking device 19 opened and closed, and it mounts the carrying part 17 such that it can be rotated about the pivot axis 56. In order for the carrying part 17 to be mounted in a pivotable manner about the pivot axis 56, it is possible, for example, for a bearing pin of the carrying part 17 to engage in a bearing aperture of the guidance part 57.

It would also be possible for the carrying part 17 to pass right through the guidance part 57 and for the screw surface 55 to be arranged on the carrying part 17.

Adjustment of the carrying part 17 in a direction at right angles to the pull-out direction 5 and at right angles to the transverse direction 50 in order to open and close the locking device could also be achieved, for example, by a control part which is guided in the basic profile 13 such that it can be displaced parallel to the pull-out direction 5 and which has an oblique surface for the displacement of the carrying part 17.

A spring by means of which the lateral-guidance part 15 is retained in a starting position in the open state of the locking device 19, and without any external force being active, is not illustrated in FIGS. 36 to 38, but could be provided in turn.

A seventh exemplary embodiment of the invention is illustrated in FIGS. 39 to 44. The carrying part 17, once again, is designed in the form of an eccentric and, when the locking device 19 is opened and closed, the carrying part 17 is adjusted vertically, in particular as illustrated in the exemplary embodiment, in a direction located at right angles to the transverse direction 50 and at right angles to the pull-out direction 5. Adjustment takes place here by means of a control part 58, which can be rotated about a pivot axis 59, located parallel to the transverse direction 50, by means of an actuating element 23 designed in the form of a lever. The actuating part 58 has a cam formation which interacts with a bearing part 60, which mounts the carrying part 17 such that it can be rotated about its axis of rotation 18. The bearing part 60 is guided such that it can be displaced in relation to the basic profile 13 of the first guide rail 7 in the direction in which the carrying part 17 is to be adjusted when the locking device 19 is opened and closed. For this purpose, use is made of guidance pins 61, which are secured on the basic profile 13 and engage in guidance apertures of the bearing part 60.

The engagement surfaces 25, 26, which interact in the closed state of the locking device 19, may be designed in a manner analogous to that described in the sixth exemplary embodiment.

For all the exemplary embodiments described, it would be conceivable and possible for the lateral-guidance part 15 used, instead of a roller, to be a sliding part which interacts with the at least one lateral-guidance surface, preferably with lateral-guidance surfaces 30, 31 located on either side of the sliding part.

Pull-out guides designed in a manner according to the invention may also be provided, or adapted specifically, for pulling out pull-out furniture parts other than drawers, for example for pulling out shelves, tall-cabinet pull-out mechanisms, etc.

In many applications, the pull-out direction 5 will be located horizontally, or at least essentially horizontally (at least essentially horizontally here should include deviations of +/−10° in relation to the horizontal). Other pull-out directions, however, are also possible. For example, in the case of a catering-trade plate dispenser, the pull-out direction is located vertically (the pulling-out operation can be achieved or assisted here by a spring mechanism).

In many applications, use is also made of pull-out guides which are spaced apart in the transverse direction 50 and are arranged on either side of the pull-out furniture part 1, wherein the transverse direction 50 is located, in particular, horizontally. However, it is also conceivable and possible, in principle, to have applications in which one or more pull-out guides are arranged just on one side of the pull-out furniture part 1. The invention can also be used in conjunction with such pull-out guides.

The term "furniture" has a broad meaning in this document. For example, it also covers tool cabinets. "Basic structure" likewise has a broad meaning, in the sense of a load-bearing part which belongs to the piece of furniture and may be of closed or more or less open design, for example also in the form of a framework.

KEY TO THE LIST OF DESIGNATIONS

| | |
|---|---|
| 1 | pull-out furniture part |
| 2 | basic furniture structure |
| 3 | pull-out guide |
| 4 | pull-out guide |
| 5 | pull-out direction |
| 6 | basic-structure-mounted guide rail |
| 7 | first guide rail |
| 8 | second guide rail |
| 9, 9',9" | running roller |
| 10 | running roller |
| 11 | running roller |
| 12 | running roller |
| 13 | basic profile |
| 13a | Protuberance |
| 14 | lateral-guidance unit |
| 15 | lateral-guidance part |
| 16 | Axis |
| 17 | carrying part |
| 17a | Stub |
| 18 | axis of rotation |
| 19 | locking device |
| 20 | clamping part |
| 21 | pivot axis |
| 22 | axial pin |
| 23 | actuating element |
| 24 | Lever |
| 25 | engagement surface |
| 26 | engagement surface |
| 27 | mating clamping part |
| 27a | depression |
| 27b | slot |
| 28 | cam formation |
| 29 | cam formation |
| 30 | lateral-guidance surface |
| 31 | lateral-guidance surface |
| 32 | lug |
| 33 | stop surface |
| 34 | latching aperture |
| 35 | latching protrusion |
| 36 | run-in slope |
| 37 | latching aperture |
| 38 | spring |
| 38a | spring leg |
| 38b | spring leg |
| 38c | U-shaped portion |
| 39 | bearing portion |
| 40 | crosspiece |
| 41 | crosspiece |
| 42 | bearing part |
| 43 | pivot axis |
| 44 | axial pin |
| 45 | axial aperture |
| 46 | guidance protrusion |
| 47 | bearing part |
| 48 | Crosspiece |
| 49 | Crosspiece |
| 50 | transverse direction |
| 51 | sliding piece |
| 52 | clamping portion |
| 53 | control lever |
| 54 | screw surface |
| 55 | screw surface |
| 56 | pivot axis |
| 57 | guide part |
| 58 | control part |
| 59 | pivot axis |
| 60 | bearing part |
| 61 | guidance pin |

The invention claimed is:

1. A pull-out guide for pulling a pull-out furniture part out of a furniture body in a pull-out direction and for pushing the pull-out furniture part into the furniture body counter to the pull-out direction, comprising at least a first and a second guide rail, which are displaceable relative to one another in and counter to the pull-out direction, the first guide rail has a profiled rail member and at least one lateral-guidance unit, which is retained on the profiled rail member and which comprises:

a lateral-guidance part, which in order to limit an amount of play of the second guide rail in relation to the first guide rail in at least a transverse direction extending at a right angle to the pull-out direction, interacts with at least one lateral-guidance surface of the second guide rail, a position of the lateral-guidance part is adjustable in the transverse direction in relation to the profiled rail member of the first guide rail, an openable and closeable locking device provided on the lateral-guidance unit which, in an open state of the locking device, allows adjustment of the position of the lateral-guidance part is moveable in the transverse direction in relation to the profiled rail member of the first guide rail by application of pressure on the lateral-guidance part parallel to the transverse direction, and in a closed state of the locking device, the position of the lateral-guidance part is fixed in the transverse direction in relation to the profiled rail member of the first guide rail, wherein the second guide rail has lateral-guidance surfaces which are located on opposite sides of the lateral-guidance part and with which the lateral-guidance part interacts in order to limit an amount of play of the second guide rail in relation to the first guide rail in opposite transverse directions extending at right angles to the pull-out direction.

2. The pull-out guide as claimed in claim 1, wherein the lateral-guidance surfaces, which are located on the opposite sides of the lateral-guidance part, are formed by a portion of the second guide rail which is U-shaped as seen in the pull-out direction.

3. The pull-out guide as claimed in claim 1, wherein the locking device comprises an actuating lever pivotable about a pivot axis, or a stop lever, which is pivoted along with the actuating lever when the actuating lever is pivoted, forms a disengagement-prevention device for the second guide rail.

4. The pull-out guide as claimed in claim 1, wherein the first guide rail has at least two lateral guidance units, which are spaced apart from one another as seen in the pull-out direction.

5. The pull-out guide as claimed in claim 1, wherein the first guide rail forms a center rail of the pull-out guide, and said center rail is displaceably guided in and counter to the pull-out direction in relation to a fixed rail of the pull-out guide, said fixed rail being fitted on the furniture body, and the second guide rail is a pull-out rail that is fitted on a pull-out furniture part and is displaceably guided in and counter to the pull-out direction in relation to the center rail.

6. An assembly for pulling a pull-out furniture part out of a furniture body, wherein the assembly has first and second pull-out guides as claimed in claim 1.

7. The assembly as claimed in claim 6, wherein the first and second pull-out guides are spaced apart from one another in the transverse direction.

8. The pull-out guide as claimed in claim 1, wherein the locking device comprises an actuating lever pivotable about a pivot axis.

9. A pull-out guide for pulling a pull-out furniture part out of a furniture body in a pull-out direction and for pushing the pull-out furniture part into the furniture body counter to the pull-out direction, comprising at least a first and a second guide rail, which are displaceable relative to one another in and counter to the pull-out direction, the first guide rail has a profiled rail member and at least one lateral-guidance unit, which is retained on the profiled rail member and which comprises:

a lateral-guidance part, which in order to limit an amount of play of the second guide rail in relation to the first guide rail in at least a transverse direction extending at a right angle to the pull-out direction, interacts with at least one lateral-guidance surface of the second guide rail, a position of the lateral-guidance part is adjustable in the transverse direction in relation to the profiled rail member of the first guide rail, a locking device having an actuating element which is displaceable between an open position and a closed position, wherein in the open position of the actuating element the locking device assumes an open state, in which the position of the lateral-guidance part is moveable in the transverse direction in relation to the profiled rail member of the first guide rail by application of pressure on the lateral-guidance part parallel to the transverse direction, and in the closed position of the actuating element the locking device assumes a closed state, in which the position of the lateral-guidance part is fixed in the transverse direction in relation to the profiled rail member of the first guide rail, wherein, in the closed state of the locking device, a carrying part, which carries the lateral-guidance part, is braced with a clamping part of the lateral-guidance unit or with a clamping portion of the profiled rail member of the first guide rail, and wherein the carrying part comprises an eccentric.

10. The pull-out guide as claimed in claim 9, wherein the lateral-guidance part comprises a roller mounted by the carrying part for rotation about an axis.

11. A pull-out guide for pulling a pull-out furniture part out of a furniture body in a pull-out direction and for pushing the pull-out furniture part into the furniture body counter to the pull-out direction, comprising at least a first and a second guide rail, which are displaceable relative to one another in and counter to the pull-out direction, the first guide rail has a profiled rail member and at least one lateral-guidance unit, which is retained on the profiled rail member and which comprises:

a lateral-guidance part, which in order to limit an amount of play of the second guide rail in relation to the first guide rail in at least a transverse direction extending at a right angle to the pull-out direction, interacts with at least one lateral-guidance surface of the second guide rail, a position of the lateral-guidance part is adjustable in the transverse direction in relation to the profiled rail member of the first guide rail, a locking device having an actuating element which is displaceable between an open position and a closed position, wherein in the open position of the actuating element the locking device assumes an open state, in which the position of the lateral-guidance part is moveable in the transverse direction in relation to the profiled rail member of the first guide rail by application of pressure on the lateral-guidance part parallel to the transverse direction, and in the closed position of the actuating element the locking device assumes a closed state, in which the position of the lateral-guidance part is fixed in the transverse direction in relation to the profiled rail member of the first guide rail, wherein, upon the pull-out guide being pushed together from a pulled-out state into a pushed-in state, a stop surface of the second guide rail runs onto the actuating element, which is located in the open position, and adjusts the actuating element into the closed position.

12. A pull-out guide for pulling a pull-out furniture part out of a furniture body in a pull-out direction and for pushing the pull-out furniture part into the furniture body counter to the pull-out direction, comprising at least a first and a second guide rail, which are displaceable relative to one another in and counter to the pull-out direction, the first guide rail has a profiled rail member and at least one lateral-guidance unit, which is retained on the profiled rail member and which comprises:

a lateral-guidance part, which in order to limit an amount of play of the second guide rail in relation to the first guide rail in at least a transverse direction extending at a right angle to the pull-out direction, interacts with at least one lateral-guidance surface of the second guide rail, a position of the lateral-guidance part is adjustable in the transverse direction in relation to the profiled rail member of the first guide rail, an openable and closeable locking device provided on the lateral-guidance unit which, in an open state of the locking device, allows adjustment of the position of the lateral-guidance part is moveable in the transverse direction in relation to the profiled rail member of the first guide rail by application of pressure on the lateral-guidance part parallel to the transverse direction, and in a closed state of the locking device, the position of the lateral-guidance part is fixed in the transverse direction in relation to the profiled rail member of the first guide rail, wherein in the open state of the locking device, and without an external force acting on the lateral-guidance part, the lateral-guidance part (15) is retained in a starting position by at least one spring.

13. The pull-out guide as claimed in claim 12, wherein legs of the at least one spring butt against opposite sides of the carrying part and, upon displacement of the lateral-guidance part in a transverse direction, force the carrying part in such a direction as to restore the lateral-guidance part into a starting position thereof.

* * * * *